US011185147B2

(12) United States Patent
Willows et al.

(10) Patent No.: US 11,185,147 B2
(45) Date of Patent: Nov. 30, 2021

(54) HAND STRAP BOTTLE CLIP

(71) Applicant: Amphipod, Inc., Seattle, WA (US)

(72) Inventors: Keith S Willows, Seattle, WA (US); June A. Angus, Seattle, WA (US); Antonio Del Rosario, Bellevue, WA (US)

(73) Assignee: Amphipod, Inc.

( * ) Notice: Subject to any disclaimer, the term of this patent is extended or adjusted under 35 U.S.C. 154(b) by 0 days.

(21) Appl. No.: 16/826,611

(22) Filed: Mar. 23, 2020

(65) Prior Publication Data

US 2020/0305582 A1 Oct. 1, 2020

Related U.S. Application Data

(60) Provisional application No. 62/995,439, filed on Jan. 27, 2020, provisional application No. 62/919,791, filed on Mar. 30, 2019.

(51) Int. Cl.
*A45F 3/16* (2006.01)
*A45F 5/00* (2006.01)

(52) U.S. Cl.
CPC ..... *A45F 3/16* (2013.01); *A45F 2005/006* (2013.01); *A45F 2200/0583* (2013.01)

(58) Field of Classification Search
CPC ..... A45F 2200/0583; A45F 3/16; A45F 5/10; A45F 2005/1006; A45F 2005/1013; B65D 23/104; B65D 23/106
USPC ..... 224/218
See application file for complete search history.

(56) References Cited

U.S. PATENT DOCUMENTS

| | | | | | |
|---|---|---|---|---|---|
| 2,418,410 | A * | 4/1947 | Hull | H04R 25/04 | 24/3.11 |
| 4,905,879 | A * | 3/1990 | Piccone | A44C 5/0069 | 224/173 |
| 5,235,728 | A * | 8/1993 | Nordberg | A45F 5/02 | 224/667 |
| 5,411,194 | A * | 5/1995 | Nagasawa | A45C 13/26 | 224/254 |
| 5,551,079 | A * | 8/1996 | Panther | H04B 1/086 | 340/7.63 |
| 6,279,794 | B1 * | 8/2001 | Miyazaki | A45F 3/16 | 224/148.4 |
| 6,857,544 | B2 * | 2/2005 | Dahl | A45F 3/14 | 224/148.4 |
| 9,204,710 | B1 * | 12/2015 | Burns | H04B 1/3888 | |
| 9,480,323 | B2 * | 11/2016 | Lyon | B65D 21/086 | |
| 10,123,642 | B2 * | 11/2018 | Gazibara | A47G 23/0241 | |
| 2007/0029360 | A1 * | 2/2007 | Connelly | B60R 7/08 | 224/312 |
| 2010/0206919 | A1 * | 8/2010 | Boyom | A45F 5/02 | 224/148.4 |
| 2019/0090617 | A1 * | 3/2019 | Karl, IV | A45F 3/16 | |

* cited by examiner

*Primary Examiner* — Adam J Waggenspack
(74) *Attorney, Agent, or Firm* — Lowe Graham Jones PLLC

(57) ABSTRACT

A hand strap bottle clip is configured for use with a bottle, and includes a clip attachable to an upper end of the bottle and having a lower end of the clip extending downwardly toward a lower end of the bottle when the clip is attached to the bottle. The clip includes upper and lower attachment locations or slots. A strap is attached to the clip at the upper and lower attachment locations to form a hand loop sized to accommodate a hand of a user.

19 Claims, 30 Drawing Sheets

HAND STRAP BOTTLE CLIP

PRIORITY CLAIM

This application claims the benefit of U.S. provisional application No. 62/919,791 filed Mar. 30, 2019, and the benefit of U.S. provisional application No. 62/995,439, filed Jan. 27, 2020, the contents of each which are incorporated by reference.

FIELD OF THE INVENTION

This invention generally relates to clips and straps for use with bottles for water or other beverages.

SUMMARY OF THE INVENTION

A hand strap bottle clip is configured for use with a bottle, the bottle having a lower end and an opposite upper end with a neck and a bottle cap. In one version, the hand strap bottle clip includes a clip having an upper end and a lower end, the upper end of the clip being attachable to the upper end of the bottle wherein the lower end of the clip extends downwardly toward the lower end of the bottle when the clip is attached to the bottle. The clip may further have an upper slot at the upper end of the clip and a lower slot at the lower end of the clip. A strap is attached to the clip at the upper slot and at the lower slot, whereby the strap and the clip combine to form a hand loop sized to accommodate a hand of a user.

In some versions, the clip has an intermediate slot between the upper slot and the lower slot, and the strap extends through the upper slot, the intermediate slot, and the lower slot.

In some examples, the strap includes a first end attached to the lower slot, an intermediate portion extending through the intermediate slot and through the upper slot to form a hand loop portion between the lower slot and the intermediate slot, and a second end extending beyond the upper slot, the second end being removably attached to the hand loop portion.

In some preferred examples, the intermediate slot is curved upwardly.

In some examples, the strap further comprises a swatch of hook material, wherein the second end of the strap is removably attached to the hand loop portion by removable attachment of the swatch of hook material. In a preferred form, the swatch of hook material is attached to the second end of the strap.

In preferred versions, the strap is formed from an elastomeric material.

In some versions, the clip is in a relaxed state when removed from the bottle and in a tension state when attached to the bottle, wherein in the tension state the lower end of the clip is in contact with and urged against a sidewall of the bottle. Preferably, the upper end of the clip comprises an opening for receiving the neck of the bottle, the upper end of the clip defining a plane, and further wherein the lower end of the clip extends away from the plane in a direction defining a first acute angle in the relaxed state and defining a second acute angle in the tension state, the first acute angle being smaller than the second acute angle.

In some versions, one or more projections extend radially inward from the opening. Optionally, the bottle comprises one or more steps sized and positioned to receive the one or more projections, whereby the one or more projections and the one or more steps cooperate to prevent rotation of the clip with respect to a central axis extending through the neck of the bottle.

In some versions, the strap includes a first end attached to the lower slot, an intermediate portion extending through the intermediate slot and through the upper slot to form a hand loop portion between the lower slot and the intermediate slot, the strap further having a second end extending beyond the upper slot, the second end being removably attached to the hand loop portion. Preferably, the strap is formed from an elastomeric material, and an outer layer is attached to the second end of the strap, the outer layer being formed from a non-elastomeric material. The upper slot may be separated from the intermediate slot to define an expansion area between the hand loop portion and the second end of the strap, whereby the hand loop area is resiliently expandable into the expansion area.

In some examples, a hand strap bottle clip for use with a bottle includes a clip having an upper end with an opening configured to receive the neck of the bottle within the clip and to retain the clip to the bottle when the cap is attached to the neck. The clip includes a lower end extending downwardly toward the lower end of the bottle when the clip is attached to the bottle, and an upper attachment location at the upper end of the clip and a lower attachment location at the lower end of the clip. The strap is attached to the clip at the upper attachment location and at the lower attachment location, whereby the strap and the clip combine to form a hand loop sized to accommodate a hand of a user.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
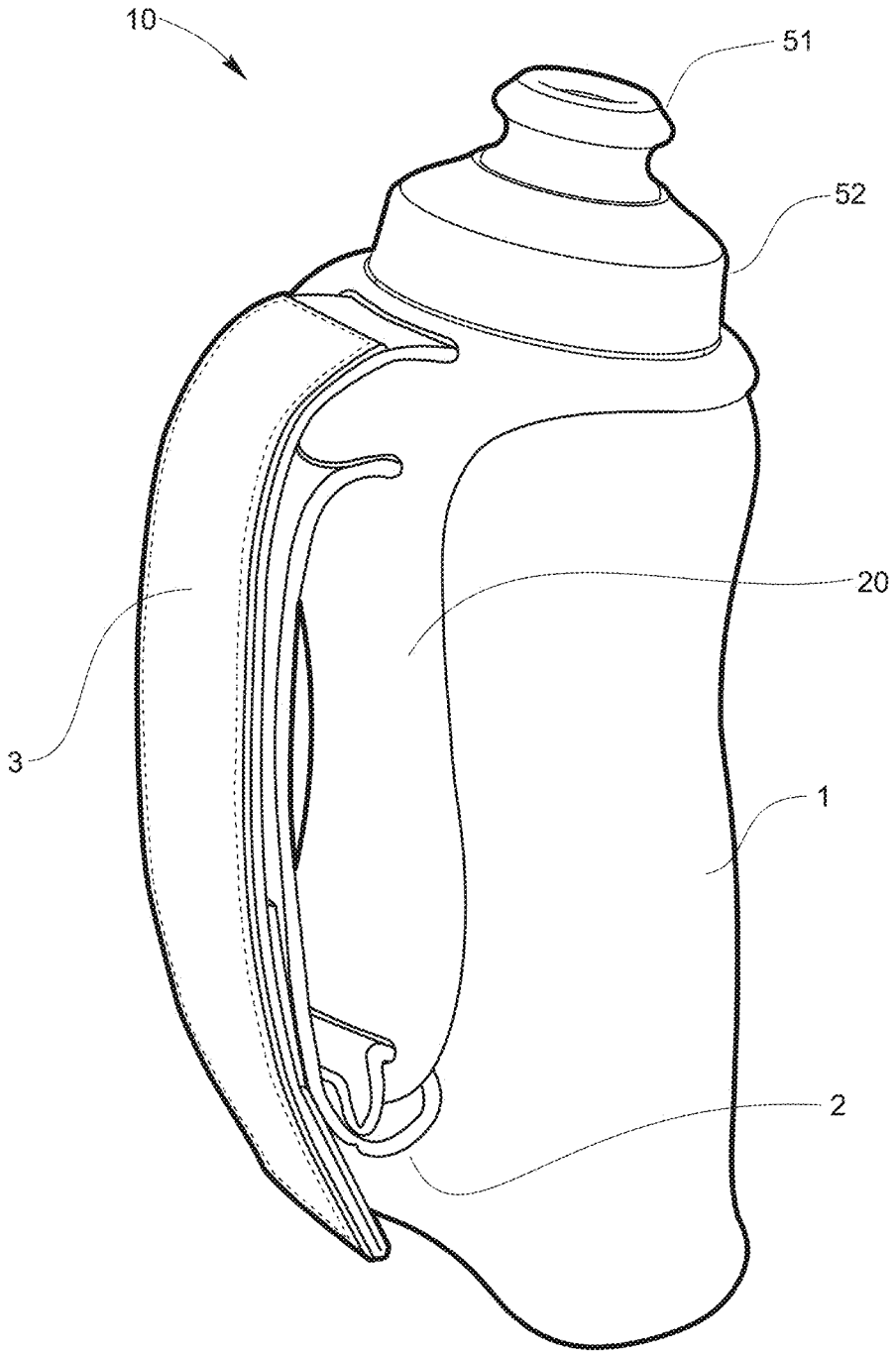
FIG. 1 is a rear three-quarter perspective view of a preferred hand strap bottle clip, shown attached to a bottle.

FIG. 1 is a rear three-quarter perspective view of a preferred embodiment 10 of a clip 20 with a hand strap 2 attached to a bottle 1. The combined embodiment further includes a logo/tag area 3 on a portion of the strap. The bottle includes a cap 52 and a spout 51.

The clip 20 is preferably injection molded from nylon (optionally glass filled as may be desirable), acetal, or other appropriate materials such as injection moldable plastic. Preferred versions of the clip 20 are illustrated alone, disassembled from the strap and bottle, in FIGS. 8-11. The clip 20 preferably has a number of cutouts or other features such as a collar opening 15 which is sized to fit snugly onto a bottle neck 24 such that it is held trapped in place below bottle threads 23 (labeled in FIG. 3) such that cap 52 further traps the clip 20 as can be seen in cross section in FIG. 11B.

Figure 2:
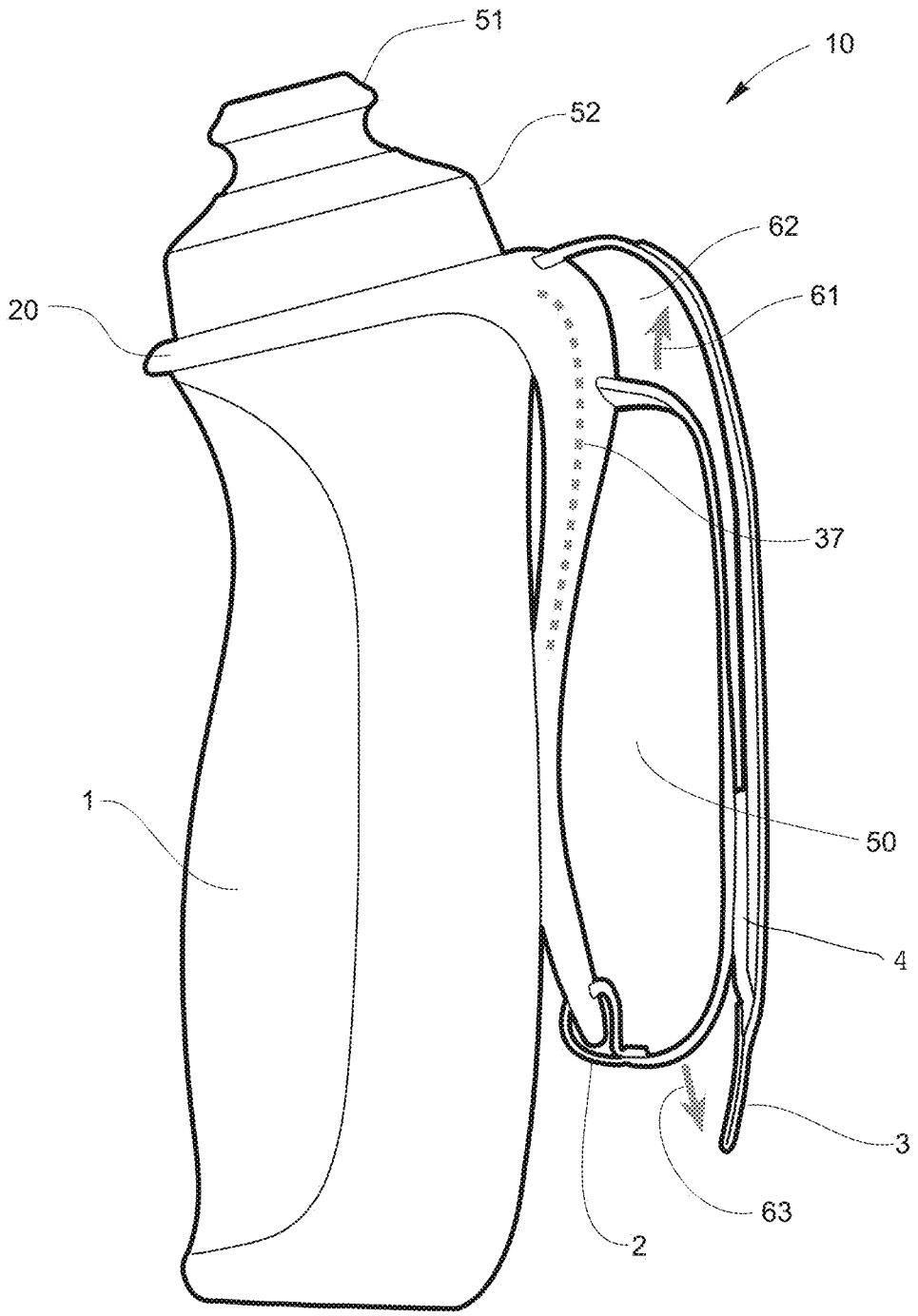
FIG. 2 is a left side view of the preferred hand strap bottle clip and bottle of FIG. 1.
Figure 12:
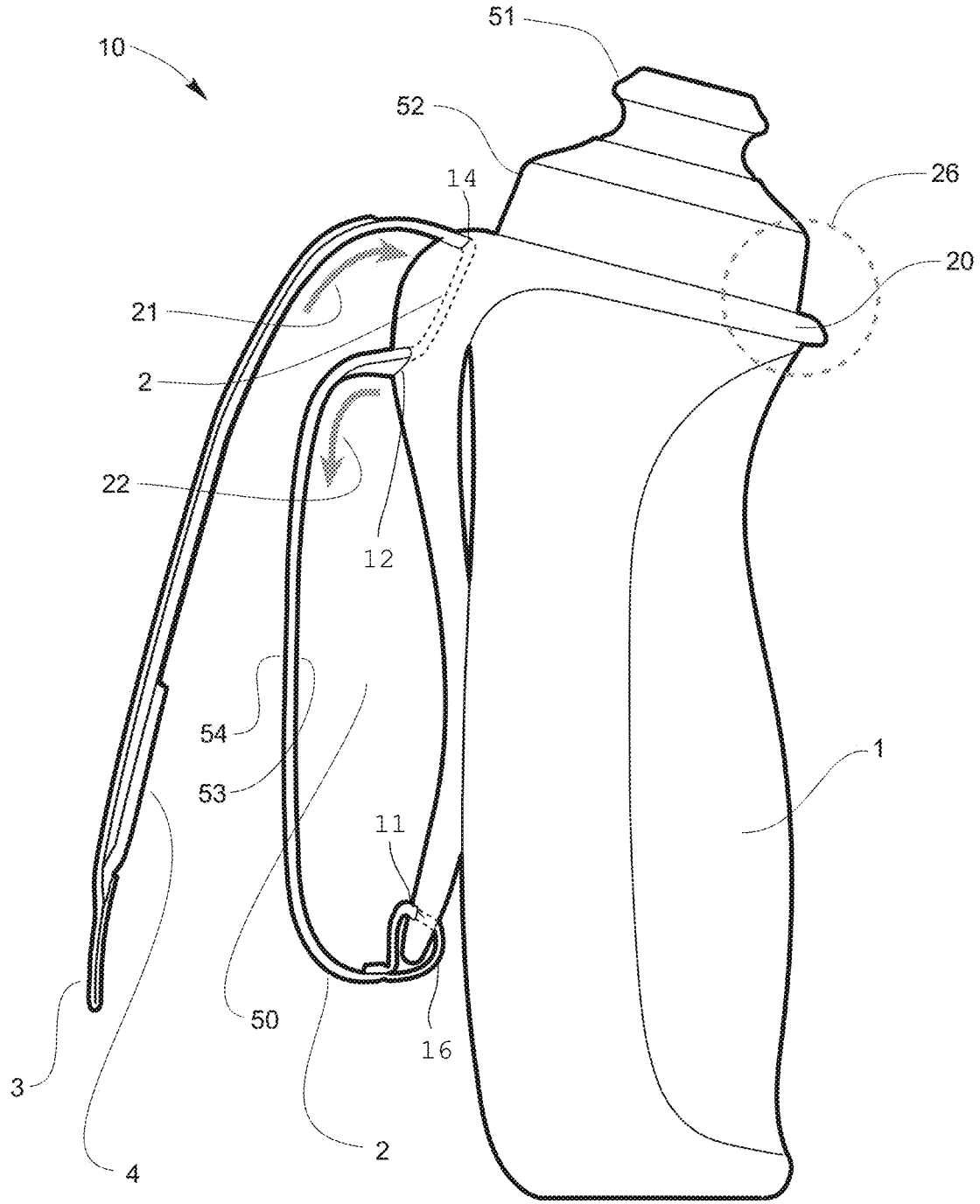
FIG. 12 is a right side view of a preferred hand strap bottle clip and bottle with arrows indicating a sliding assembly of the hand strap.

FIG. 2 is a left side view of the embodiment 10 of FIG. 1, incorporating expansion arrows 61 and 63 which indicate a direction of expansion of the strap to accommodate a hand of a user. With further reference to FIG. 12 showing the opposite side and with the hand strap in a different position, the general nature and operation of the strap is illustrated. The strap 2 is preferably cut from a length of Velstretch or other stretch strap. A swatch of hook fastener material 4 such as Velcro is affixed to a first end (adjacent reference number 3) of one side of the strap and an optional woven logo cover tag or other strip 3 is fastened to the opposite side of the first end of the strap via sewing, ultrasonic bonding or other techniques. The strap 2 preferably has an outside surface 54 and an inside surface 53 wherein at least a portion of the outside surface 54 is preferably hook-fastener (such as Velcro) compatible loop material at least in the vicinity of the location of reference number 54 in FIG. 12 near a second end of the strap. Accordingly, that hook fastener material 4 preferably is removably fastenable to the outside surface 54 of the strap which comprises loop material or loop compatible material. By feeding the strap 2 through the slots (11, 12, 14; see FIGS. 8-10) in the clip 20 in the direction of the arrows 21, 22 in FIG. 12 and attaching the hook and loop materials, the strap forms an adjustable hand loop 50 which can be sized to fit a user's hand. The logo cover tag or other cover strip 3 could be eliminated and an optional logo or tag may be printed directly on the strap 2 if desired.

Figure 8:
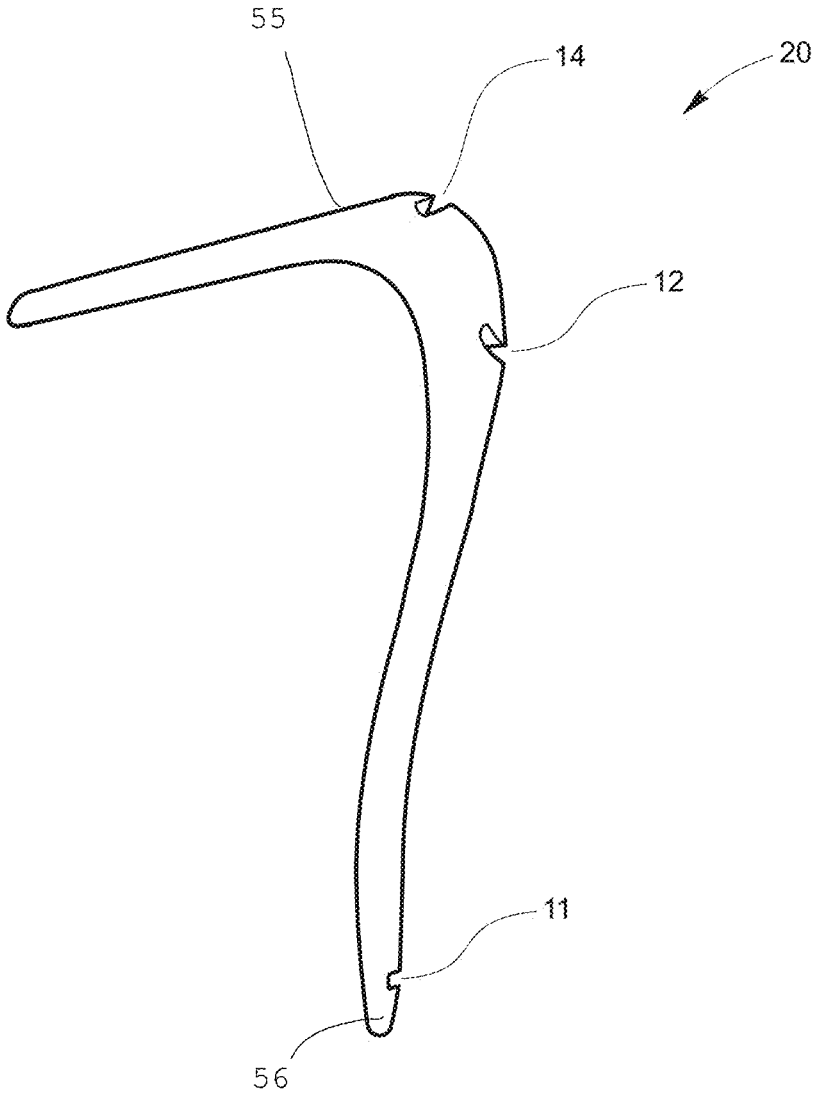
FIG. 8 is a left side view of a preferred clip, shown separated from the preferred strap and bottle. The right side view is a mirror image.
Figure 9:
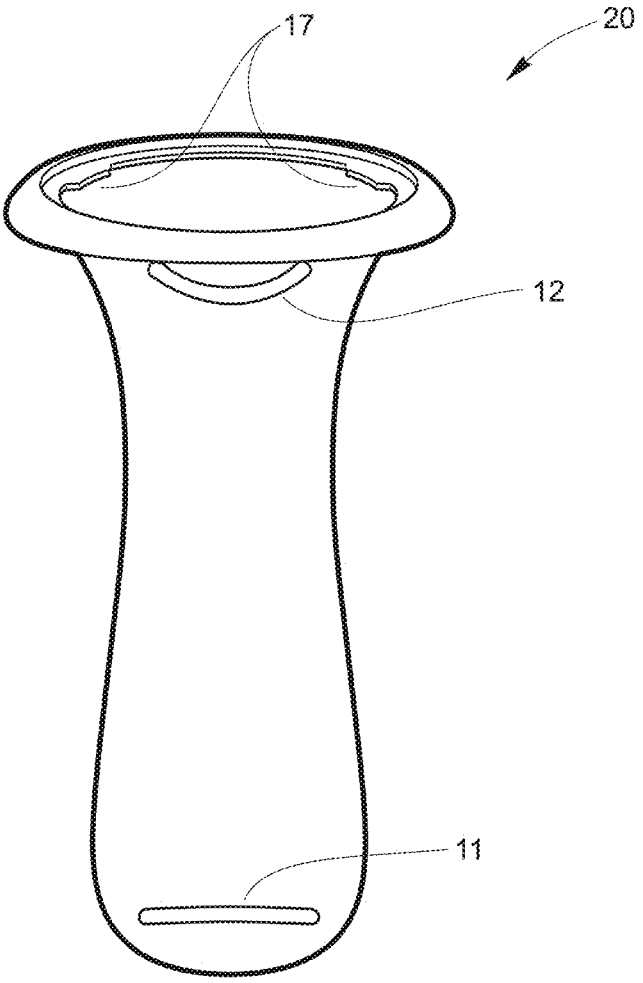
FIG. 9 is a front view of the preferred clip.
Figure 10:
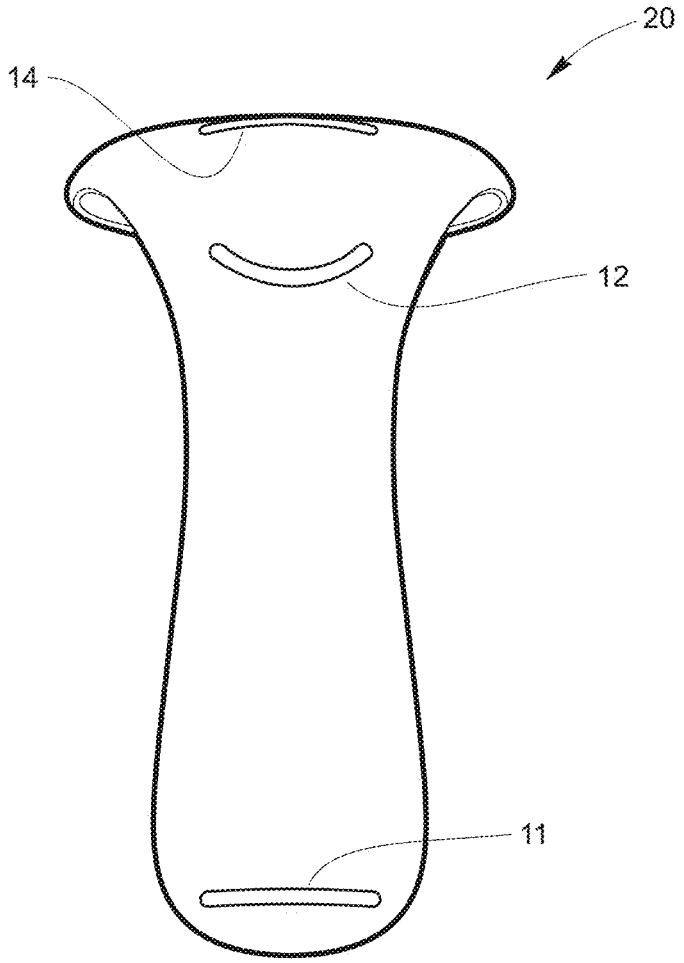
FIG. 10 is a rear view of the preferred clip.

As can be seen in FIG. 12 the strap 2 is fed through slots such as upper slot 14, intermediate slot 12 and lower slot 11 (see also FIGS. 8-10, showing the slots) wherein the strap 2 is preferably folded over in a loop 16 and sewn to itself at its second end, thereby attaching strap 2 to clip 20 at the lower clip slot 11. The slots 11, 12 and 14 as can be seen in FIGS. 8-10 are preferably molded into clip 20 and formed of the appropriate length and width such that they snugly fit the width and thickness of the strap 2. Relatedly, the width of the strap 2 is preferably less than the width of clip 20 at a width measured at slots 11, 12 and 14. The intermediate slot 12 is preferably curved upwardly such that strap 2 is confined in this curved shape as it passes through the intermediate slot 12 in clip 20. By way of reference, the "upward" curvature means that each of the two ends of the intermediate slot 11 is at a higher location than a central position of the slot between the two ends, in which the lower portion of the clip 20 is near the lower slot 11 and the upper portion of the clip is near the upper slot 14. The curved slot shape for the intermediate slot 12 serves a number of functions; for example it provides a more comfortable interface between the strap 2 and a person's hand as well as shortens the length of this cutout feature through clip 20 thereby reducing the propensity for clip 20 to break at this location.

In the preferred version as illustrated, the clip includes several connection locations which are configured as slots as described above. The slots may be configured as illustrated, or may be raised loops or similar structures. In other versions, the connection locations may be hooks, snaps, or other devices.

Figure 3:
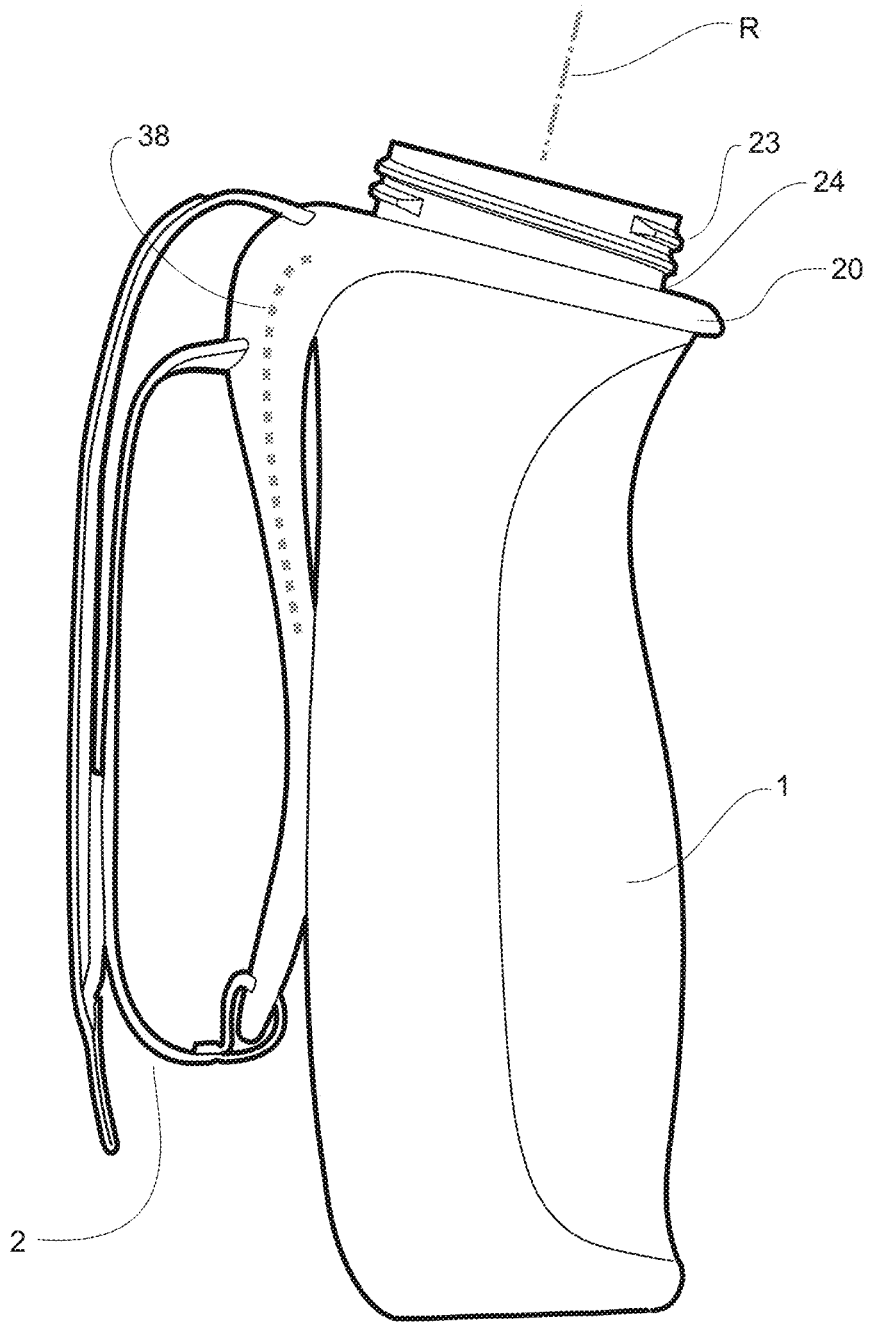
FIG. 3 is a right side view of the preferred hand strap bottle clip and bottle of FIG. 1.

The clip 20 includes an upper or proximal end 55 (see FIG. 8) with an opening 15 (see, e.g., FIG. 11A), the opening preferably being sized to accept a bottle neck 24 and threads 23. As shown in FIG. 3, the bottle neck 24 and threads 23 (which are positioned about a central axis R) extend through the clip 20. With reference again to FIG. 8, the clip 20 includes an up-turned lower or distal end 56 such that the clip 20 can be used to clip the combined embodiment 10 of a clip and water bottle with hand strap to a waistband, belt, or other support location. As mentioned, preferably the clip 20 comprises three slots, with upper slot 14 being positioned adjacent the opening 15 at the proximal or upper end 55, lower slot 11 preferably being positioned adjacent the opposite end (that is, the distal or lower end 56) of the clip 20, and intermediate slot 12 being positioned on the clip 20 between the upper slot 14 and the lower slot 11. The intermediate slot 12 is preferably positioned adjacent the upper slot 14 but at a distance such that when strap 2 is assembled to clip 20 expansion area 62 is created (see FIG. 2) such that when a user places a hand in hand loop 50, the strap 2 can stretch upwardly/outwardly into the expansion area 62 in the direction of the arrow 61 (and outward) and downwardly in the direction of the arrow 63 whereby the hand loop 50 can more readily fit a variety of hand sizes as well as stretch in a controlled manner to provide comfort yet also firmly affix a user's hand to the disclosed invention.

In many cases it is preferable for woven logo cover tag or the like strip 3 to be manufactured from material with little or no stretch such as grosgrain ribbon or similar material. And further as disclosed above strap 2 is preferably stretch Velstretch or other stretch material such that when a user places a hand in hand loop 50 the strap 2 is allowed to stretch in directions indicated by arrows 61 and 63, but the strip 3 preferably controls and restricts the stretch of the strap 2 such that the strap is comfortably worn and provides a comfortable and bounce-free weight-transfer of fluid held in bottle 1 to a user's hand.

Figure 11A:
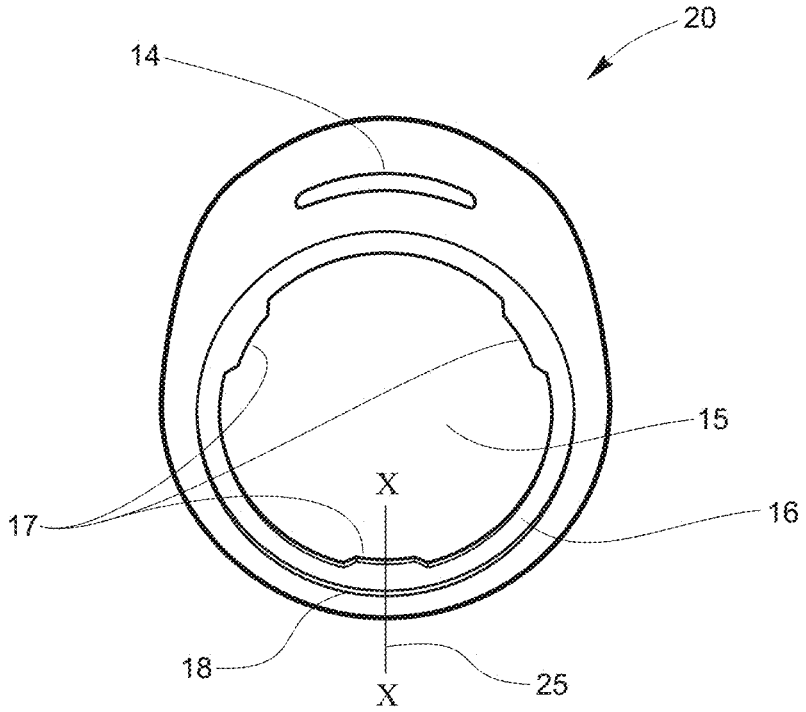
FIG. 11A is a top view of the preferred clip.
Figure 11B:
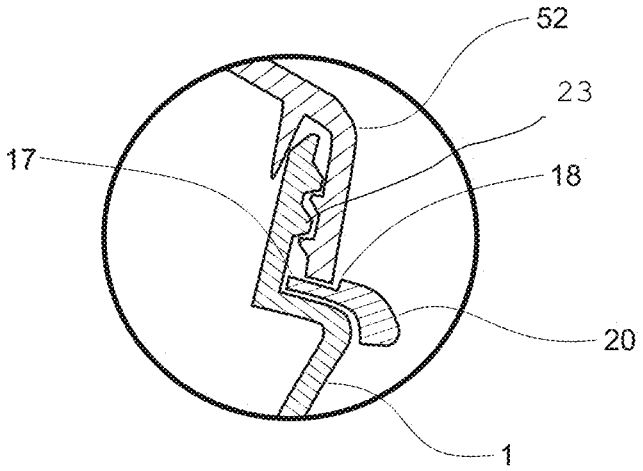
FIG. 11B is section view taken through X-X of FIG. 11A, but also showing a portion of a cap and a bottle corresponding to circular region 26 in FIG. 12.

As noted above, and as can be seen in FIG. 11A and FIG. 11B, the clip 20 includes an opening 15 at its proximal end, the opening being sized to accept bottle neck 24 as seen in FIG. 3. In one version the opening 15 is preferably formed with one or more projections 17 extending radially inward into the opening, an inward-directed step edge 18 and a step 16. Projections 17 are formed and sized such that bottle neck 24 is preferably held in a centered position within opening 15 and further facilitates removal of clip 20 from the bottle 1 whereby a user can pull and twist clip 20 to disengage it from the bottle neck 24 and threads 23, thereby removing the clip 20 from the bottle 1 for cleaning or other purposes. As can be seen in FIG. 11B, the projections 17 and step 18 are of a thickness and size to trap the clip 20 so that it is held under the threads 23 and cap 52 whereby the clip is securely held captured in place on the bottle 1.

Figure 4:
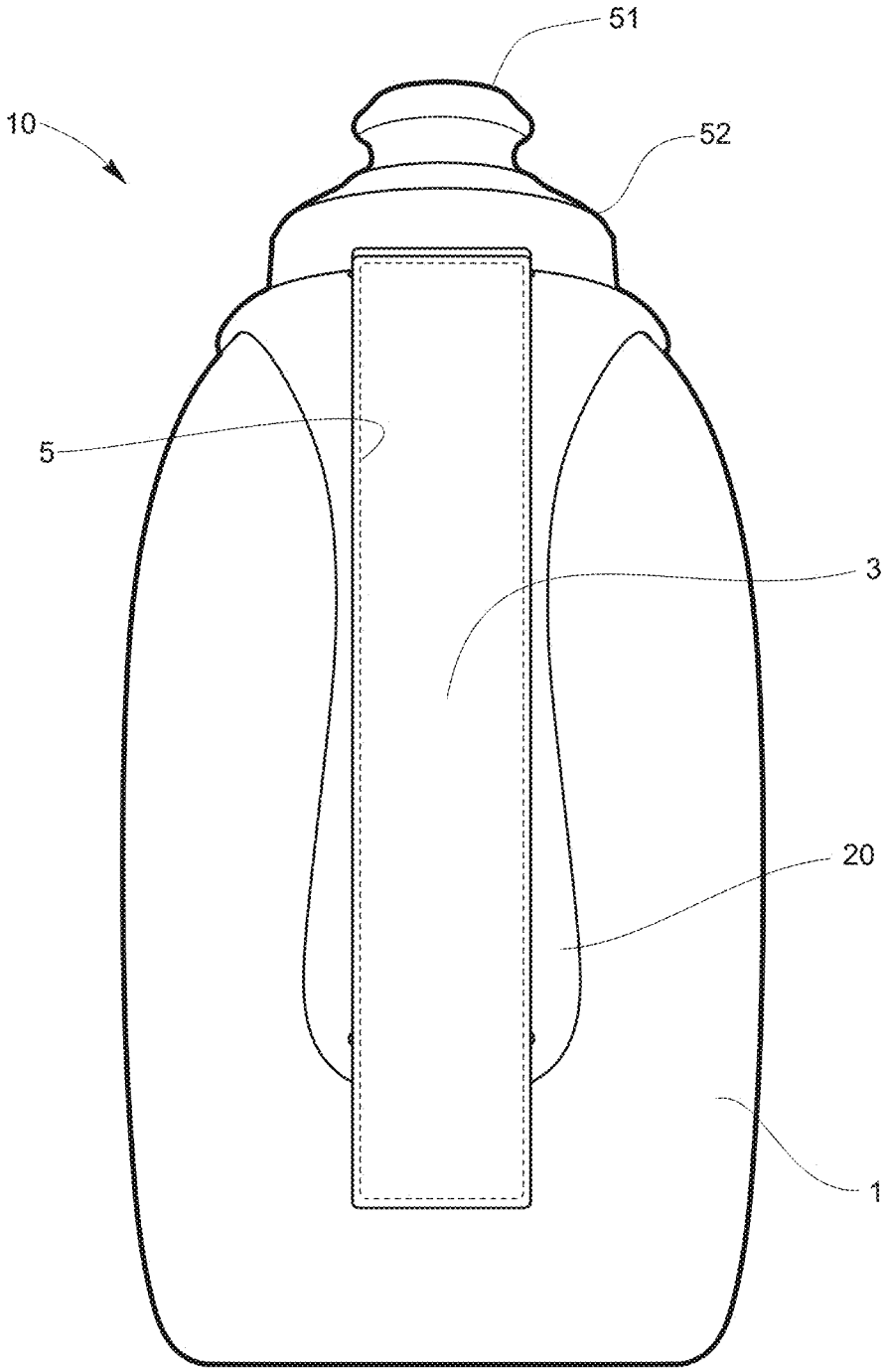
FIG. 4 is a rear view of the preferred hand strap bottle clip and bottle of FIG. 1.
Figure 5:
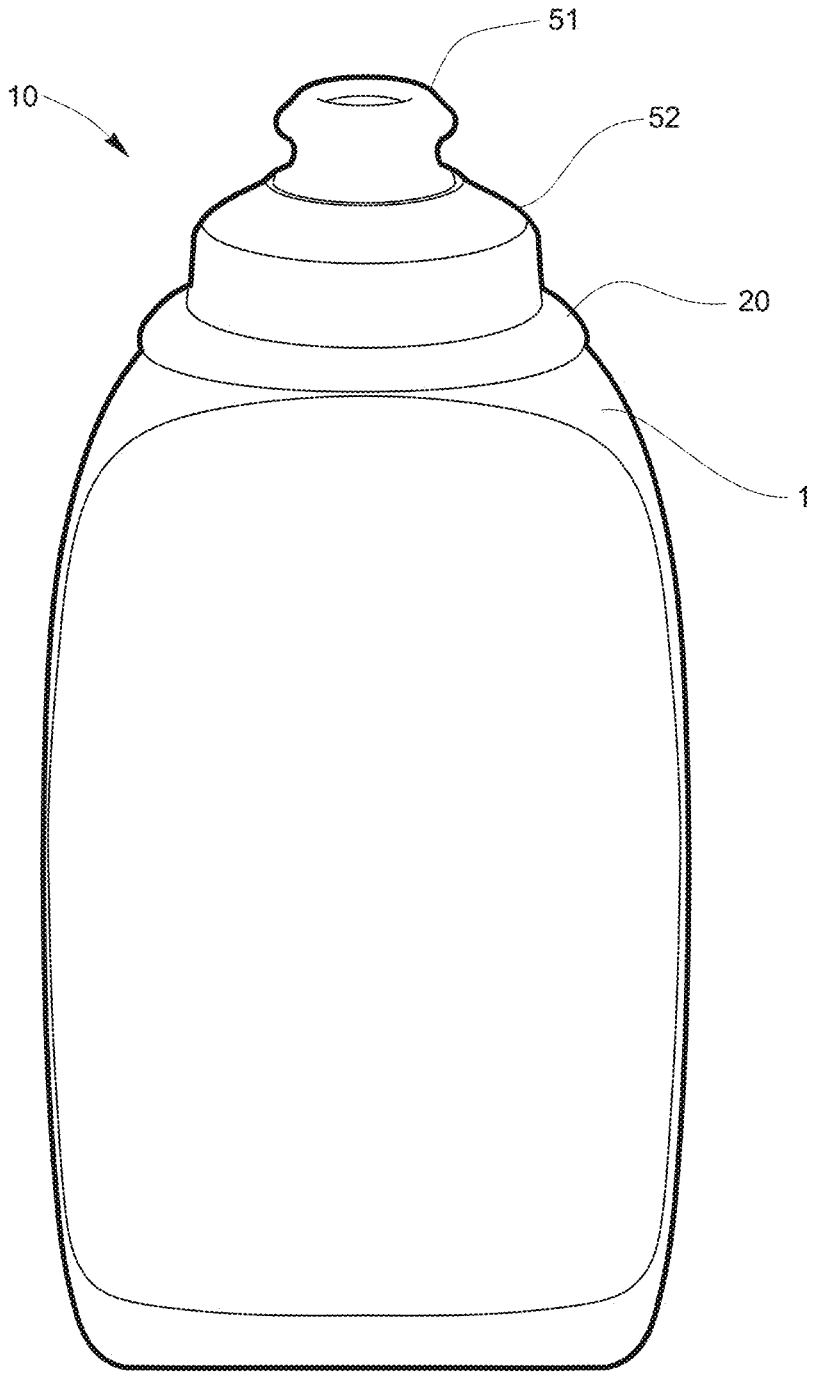
FIG. 5 is a front view of the preferred hand strap bottle clip and bottle of FIG. 1.
Figure 6B:
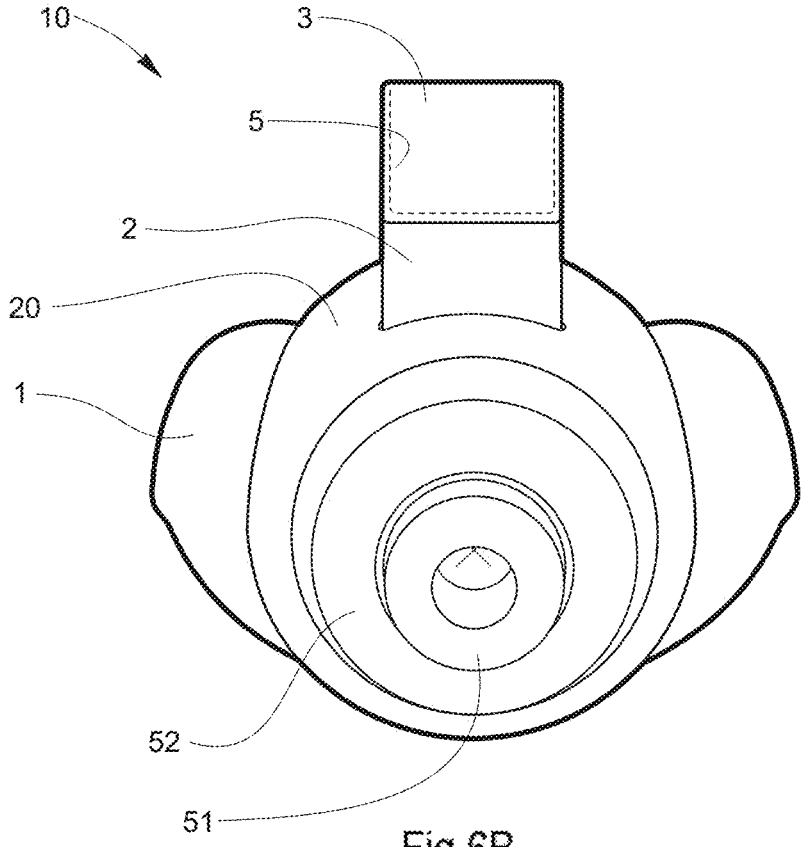
FIG. 6B is a top view of the preferred hand strap bottle clip and bottle of FIG. 1.
Figure 6A:
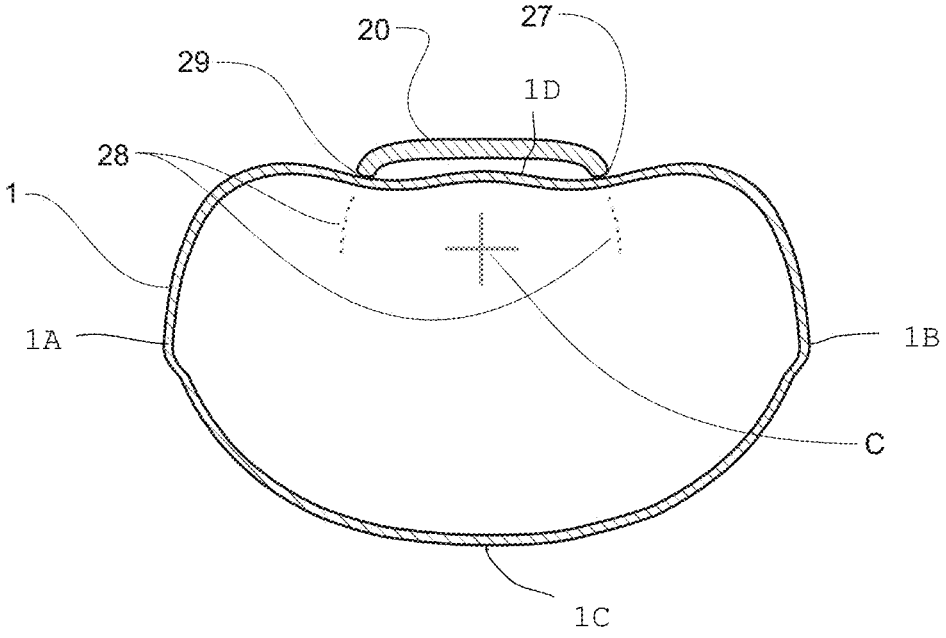
FIG. 6A is a section view taken through section plane W-W in FIG. 7.

FIG. 4 is a rear view of the combined embodiment. In this view, optional stitching 5 on the strip 3 is visible. FIG. 5 is a front view of the same embodiment. This view shows the proximal end of the clip 20 trapped between the cap 52 and the bottle 1. FIG. 6A is a top view of the above embodiment 10. FIG. 6A is a section view taken through plane W-W in FIG. 7, indicating a rotation point and the nature of the preferred sidewall configuration as discussed below.

Figure 7:
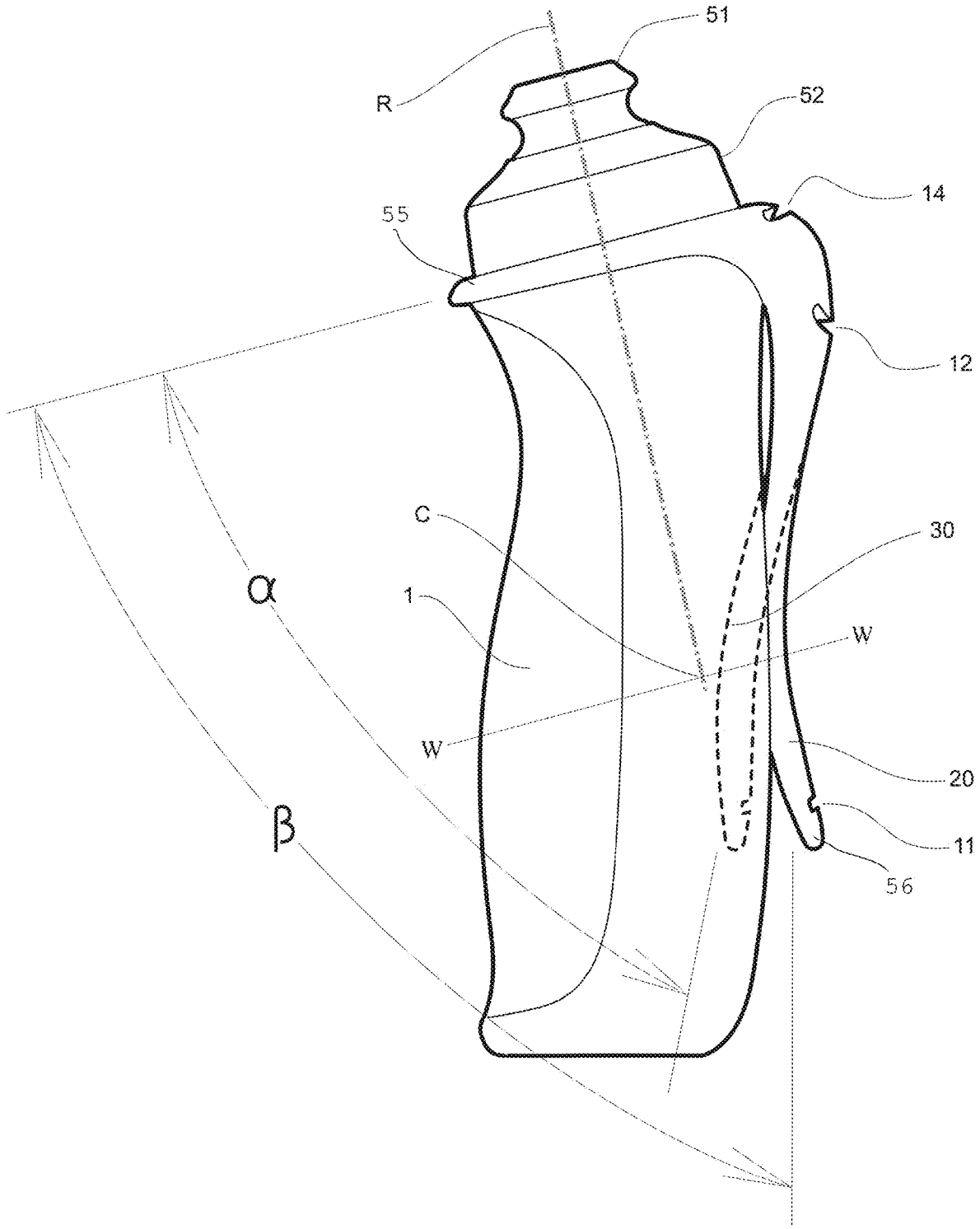
FIG. 7 is a left side view of the preferred hand strap bottle clip and bottle of FIG. 1, illustrated without the hand strap and showing the clip in a tensioned state (corresponding to solid lines for the clip and angle beta) and in a relaxed state (corresponding to dashed lines and angle alpha).

FIG. 7 is a left side view of a preferred embodiment 10, although the strap 2 and associated strap components are removed such that just the clip 20, bottle 1, cap 52 and spout 51 are shown for clarity. Broken line 30 indicates a position of the clip 20 in its relaxed state, and thus the position of the clip if a sidewall of the bottle 1 did not prevent the clip from LOWE GRAHAM JONES moving from its tensioned state as illustrated in solid lines to the relaxed state in dashed lines. The dashed lines 30 thus show how the clip 20 is formed in order to produce its tensioned state. Acute angle alpha is defined between a line generally parallel with the proximal end 55 of the clip and a line extending through the distal end 56 of the clip in its relaxed position, and thus defines this un-tensioned state 30 of the clip 20. When the clip 20 is attached to the bottle 1, a less acute angle beta (that is, a larger angle) defines a tensioned state of clip 20 wherein clip 20 is held in this tensioned state in contact with a sidewall of the bottle 1. Most preferably, a portion of the clip near the distal end is in contact with a sidewall of the bottle 1 in the tensioned state. The clip is tensioned in this position as the opening 15 is trapped under the cap 52 and distal end 56 of the clip 20 is forced outward to a less acute angle beta by the bottle walls as can be seen in FIG. 7.

Figure 36:
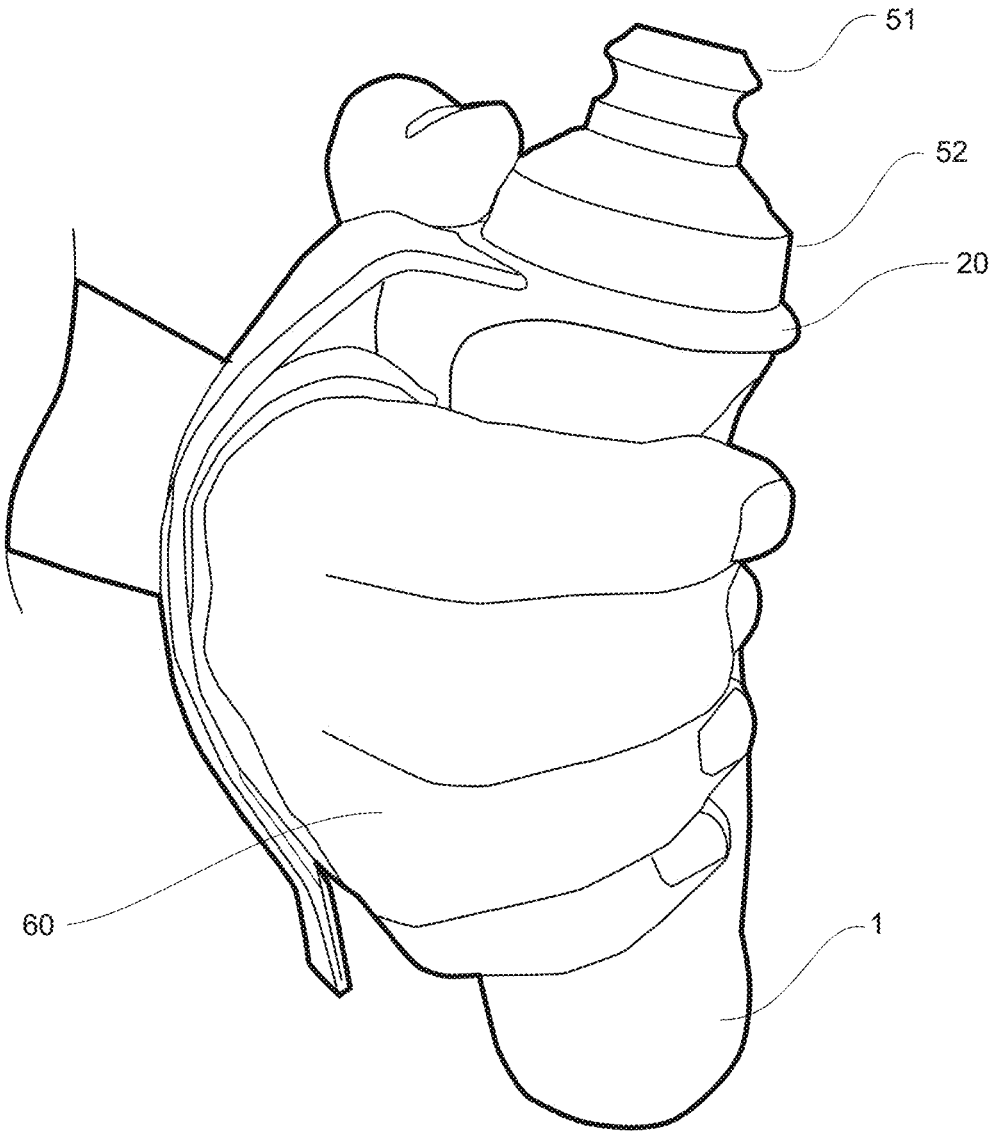
FIG. 36 is a right side perspective view of a preferred bottle clip with hand strap, showing a user grasping the bottle with a hand through the hand strap.

The clip 20 is preferably attached to the neck of bottle 1 such that it resides removably held underneath threads 23, trapped in place under cap 52 whereby clip 20 is preferably held firmly in place on bottle 1, such as illustrated in FIG. 11B. Bottle 1 preferably has opposing first 1A and second 1B sidewalls and third 1C and fourth 1D sidewalls, as seen in the sectional view of FIG. 6A, the third and fourth sidewalls being positioned between the first and second sidewalls, the fourth sidewall having a width which is preferably greater than each of the first and second sidewalls wherein when the clip 20 is installed on bottle 1 such that the clip extends down adjacent the fourth sidewall of the bottle such that the clip is preferably confined from spinning on the neck of the bottle by the fourth sidewall 1D. The combination of the preferably tensioned clip (see FIG. 7) and the disclosed bottle geometry wherein the fourth side wall is preferably wider than the first and second sidewalls effectively confines the clip, wherein when a user's hand positioned in the hand loop 50 squeezes the bottle 1 (see FIG. 36) the disclosed geometry facilitates actuating/squeezing the bottle.

As seen in FIGS. 3, 6A and 7, the bottle 1 further includes a neck 24 with a central axis R. As seen in FIG. 6A which is a section view taken on plane W-W of FIG. 7, edges 27 and 29 of clip 20 are confined from spinning around axis R at point C by the bottle walls. Rotation path 28 shows how edges 27 and 29 are confined from spinning about point C (on axis R). Thus from viewing FIG. 6A it can be understood that clip 20 can be securely confined by the bottle 1, thus when a user imparts a squeezing force to compress bottle 1 when the user's hand is in hand loop 50, the heel of the user's hand (see FIG. 36) presses on the clip 20 using preferable raised heal leverage area 37 (see FIG. 2) and opposing fingers to press on bottle walls, which facilitates squeezing of bottle 1. Thus, a squeezing force imparted on clip 20, leverage areas 37 and 38 (for left hand) does not appreciably twist the clip 20 on the neck 24, but imparts an effective squeezing force for actuating preferable squeeze bottle 1.

FIG. 12 is a right side view of a preferred embodiment 10. Arrows 21 and 22 show how strap 2 may be fed through the slots and assembled into clip 20 to form the hand loop 50 and allow it to be sized larger (and smaller, sliding in the opposite direction). The preferred hook material 4 preferably mates firmly with the facing hook compatible loop surface 54 of the strap 2. Logo tag/area 3 is sized and shaped such that it provides a generous area for a slogan, logo, emblem etc.

Figure 35:
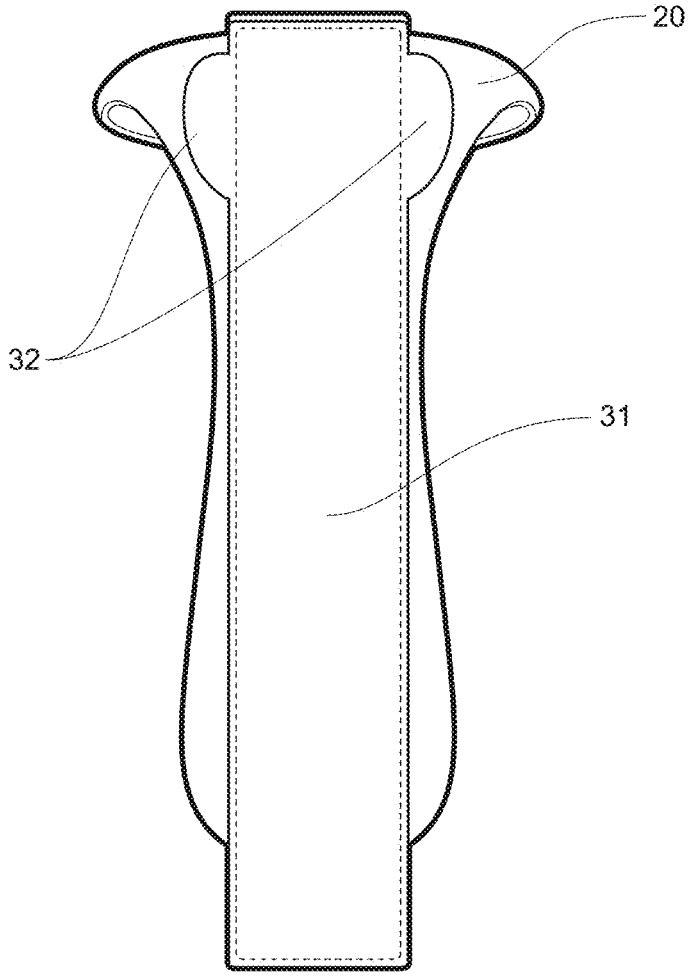
FIG. 35 is a rear view of the clip of FIG. 8, shown with a preferred strap attached.

FIG. 35 is a rear view of clip 20 with a strap installed that has an embodiment of a logo/tag area 31 that has localized "ears" or extensions 32 that can allow further customization of the logo tag/area. The logo/tag area can take many shapes or forms such as desired for promotional purposes, for example a localized area or areas can extend out such that mouse ears are formed or other shapes such that the logo tag/area can be customized further.

Figure 34:
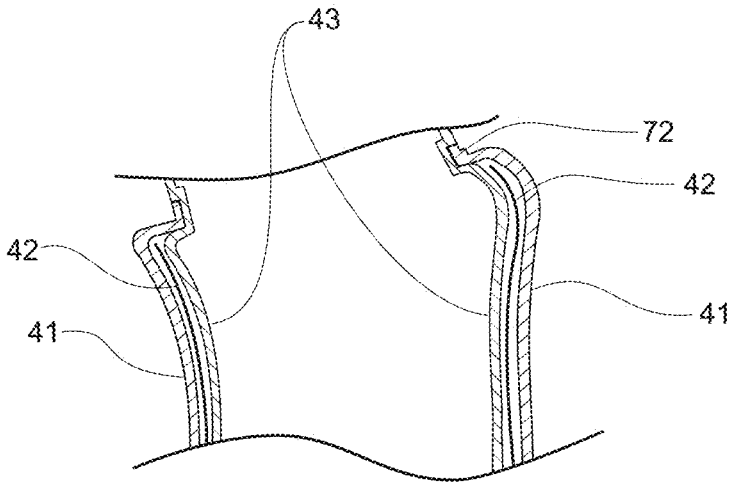
FIG. 34 is a section view through section K-K of FIG. 33.
Figure 33:
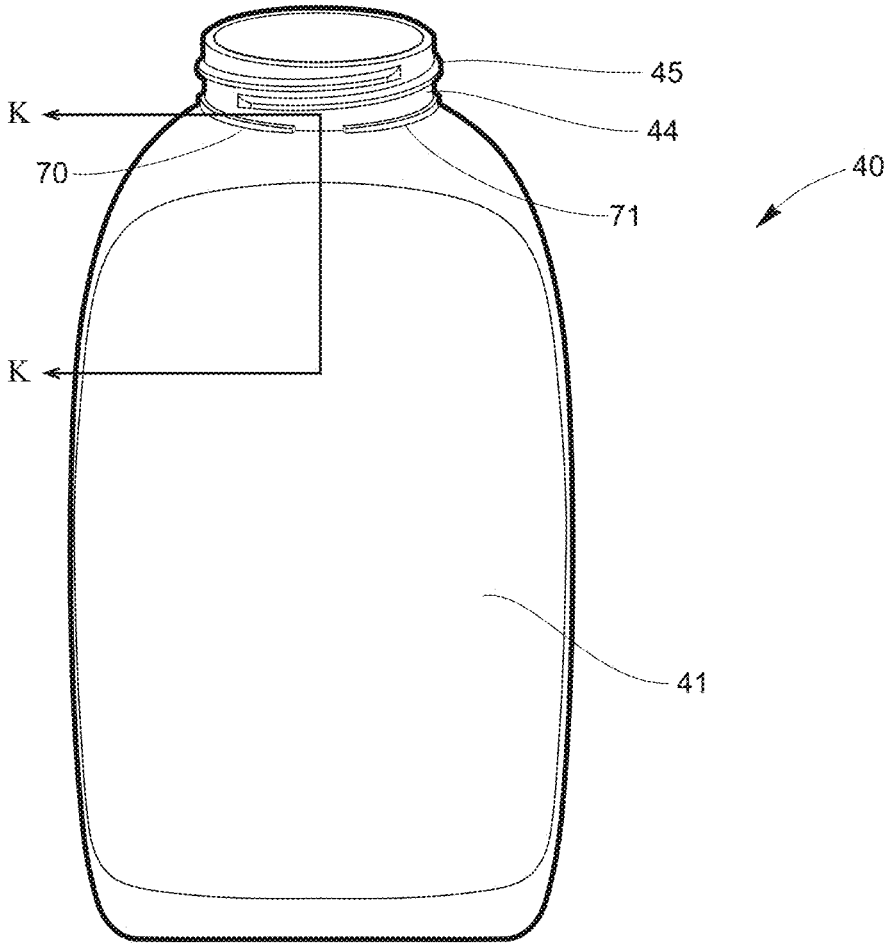
FIG. 33 is a front view of a preferred insulated bottle.

FIG. 33 is a front view of an insulated bottle embodiment 40, including an indication of section K-K which is shown in FIG. 34. FIG. 33 also shows optional steps or cavities 70 and 71 wherein slightly raised steps 70, 71 and 72 (72 is shown in cross section in FIG. 34) are provided at the base of neck 44 such that inward projections 17 of clip 20 are locked in place by insertion into corresponding steps, thereby stopping clip 20 from twisting around neck 44. Steps 70, 71, and 72 are formed at the base of neck 44 with a gap in between each step, allowing the projections 17 to nest in the three formed spaces/gaps, trapping them in place as the cap is installed and thus constraining the clip from twisting or rotating about the neck, locking it like a splined shaft in place.

FIG. 34 illustrates the exterior bottle wall 41 of the insulated embodiment, in which the exterior bottle wall 41 is held at a distance from interior wall 43 with a film/mylar or other layer 42 installed in the space in-between walls 41 and 43. Exterior walls 41 preferably comprise thin-walled LDPE or the like surfaces with sides, bottom and top opening. Interior walls 43 preferably comprise thin-walled LDPE or the like surfaces with sides, bottom and top opening wherein interior walls 43 preferably fit inside and at a distance from exterior walls 41. The internally trapped optionally printed/logoed sleeve layer 42 can be installed in between the double walls such that the vertical sides as well as bottom areas are preferably covered. Walls 41 and 43 preferably come together at the neck of bottle 40 and are preferably ultrasonically welded together such that internal sleeve 42 is held trapped inside the walls between 41 and 43.

Figure 13:
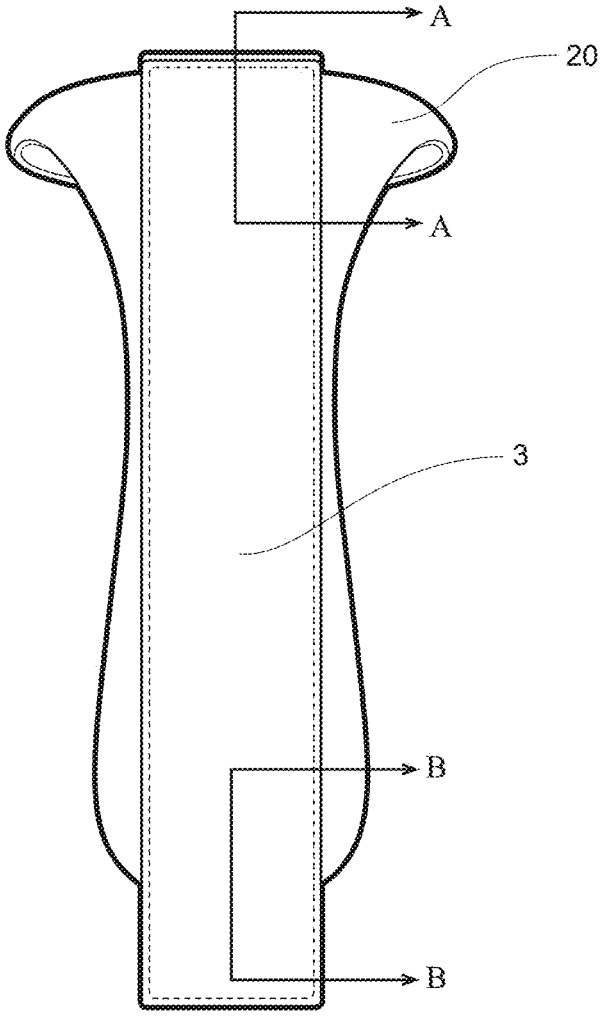
FIG. 13 is a rear view of a preferred hand strap and bottle clip, shown removed from a preferred bottle.
Figure 14:
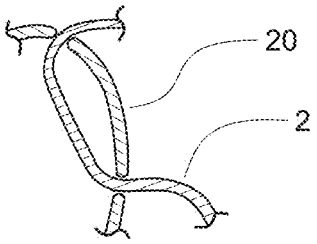
FIG. 14 is a section view through section A-A of FIG. 13.
Figure 15:
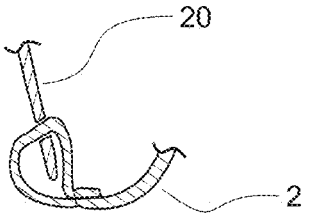
FIG. 15 is a section view through section B-B of FIG. 13.

FIG. 13 shows the clip and strap assembly disassembled from bottle, while FIG. 14 is a section view through section A-A indicated in FIG. 13. The section is a limited area for simplicity, and it illustrates the strap 2 extending through the upper and intermediate slots in the clip 20. FIG. 15 is a section view through section B-B indicated in FIG. 13. The section is a limited area for simplicity, and illustrates the strap 2 extending through the lower slot in the clip 20.

FIGS. 16 through 27 show a number of strap and clip embodiments, indicating various exemplary ways in which the strap can be attached to the clip, as well as alternate examples in which the clip can be configured to accept the strap.

Figure 16:
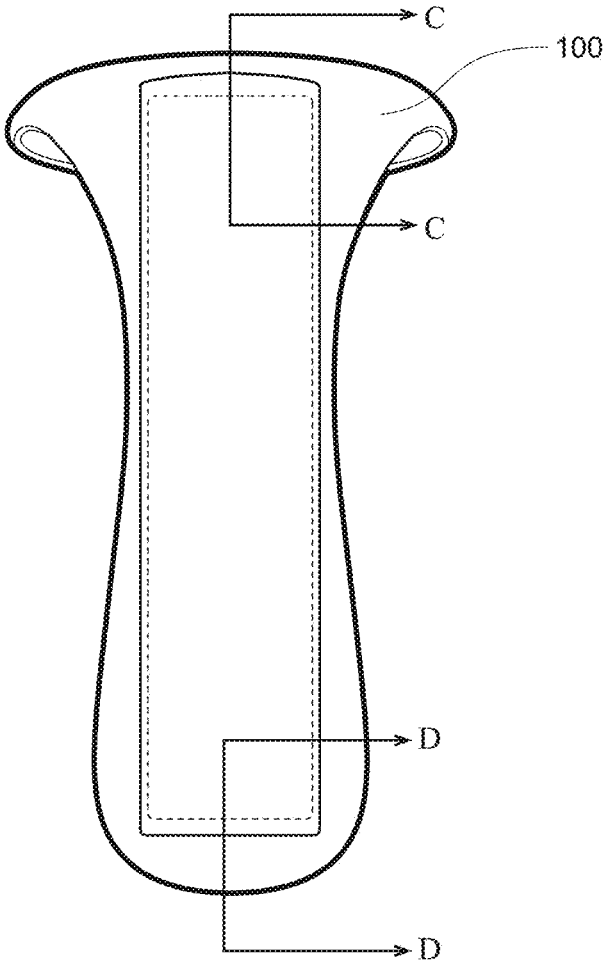
FIG. 16 is a rear view of a preferred hand strap and alternate version of a bottle clip, shown removed from a preferred bottle.
Figure 17:
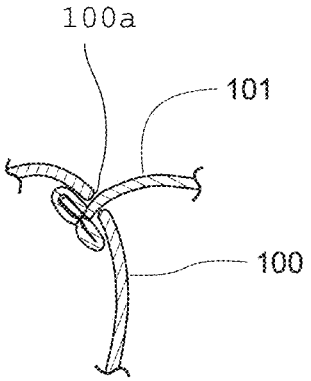
FIG. 17 is a section view through section C-C of FIG. 16.
Figure 18:
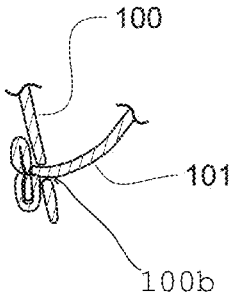
FIG. 18 is a section view through section D-D of FIG. 16.

FIG. 16 is a rear view of a clip 100 with strap 101 installed wherein clip 100 is shown removed from the bottle. FIG. 17 is a section view through section C-C of FIG. 16. In this version, strap 101 is folded over on itself and stitched in place at an upper end of the clip 100, with a portion of the strap 101 extending through an upper slot 100*a* as shown in FIG. 17. FIG. 18 is a section view through section D-D of FIG. 16, showing how a lower end of the strap 101 is folded over on itself and stitched in place at a lower end of the clip 100, with a portion of the strap 101 extending through a lower slot 100*b*.

Figure 19:
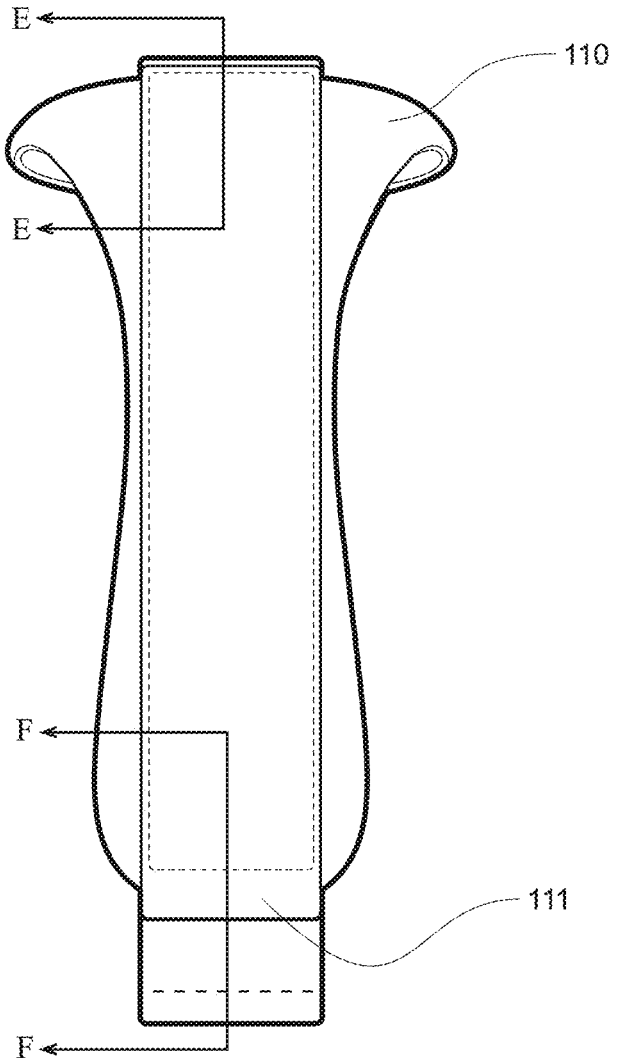
FIG. 19 is rear view of an alternate preferred hand strap and bottle clip, shown removed from a preferred bottle.
Figure 20:
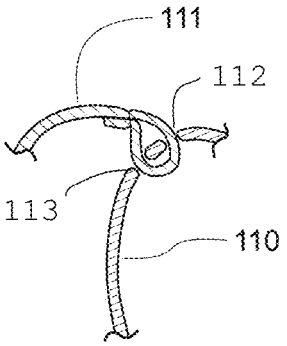
FIG. 20 is a section view through section E-E of FIG. 19.
Figure 21:
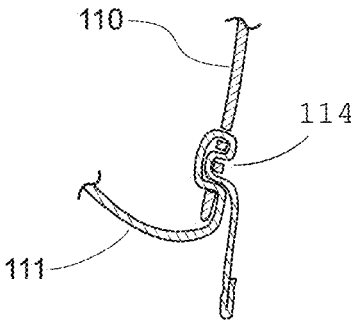
FIG. 21 is a section view through section F-F of FIG. 19.

FIG. 19 is a rear view of a clip 110 with strap installed wherein clip 110 is shown removed from the bottle. FIG. 20 is a section view through section E-E of FIG. 19. The strap 111 is looped through a pair of adjacent slots 112, 113, then folded over on itself and stitched in place as shown in FIG. 20. As shown in FIG. 21, which is a section view through section F-F of FIG. 19, the strap 111 is threaded through a ladder-lock feature 114 integrally molded into clip 110 wherein strap 111 is held retained to clip 110.

Figure 22:
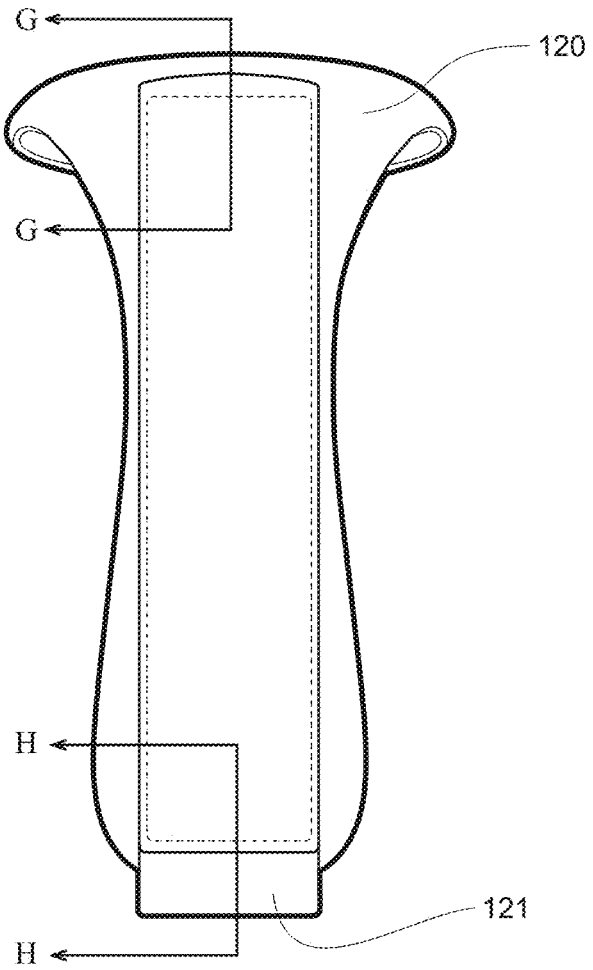
FIG. 22 is rear view of a preferred an alternate hand strap and bottle clip, shown removed from a preferred bottle.
Figure 23:
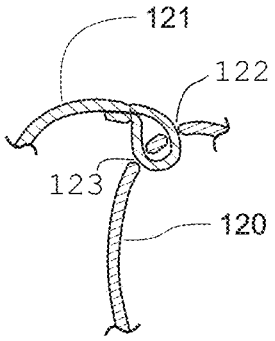
FIG. 23 is a section view through section G-G of FIG. 22.
Figure 24:
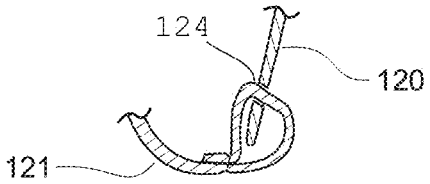
FIG. 24 is a section view through section H-H of FIG. 22.

FIG. 22 is a rear view of a clip 120 with strap 121 installed wherein clip 120 is shown removed from the bottle. FIG. 23 is a section view through section G-G of FIG. 22. The strap 111 is looped through a pair of adjacent slots 122, 123, then folded over on itself and stitched in place as shown in FIG. 20. FIG. 24 is a section view through section H-H of FIG. 22. The strap 121 is threaded through a lower slot 124, then folded over on itself and stitched in place, wherein strap 121 is held retained in clip 120.

Figure 25:
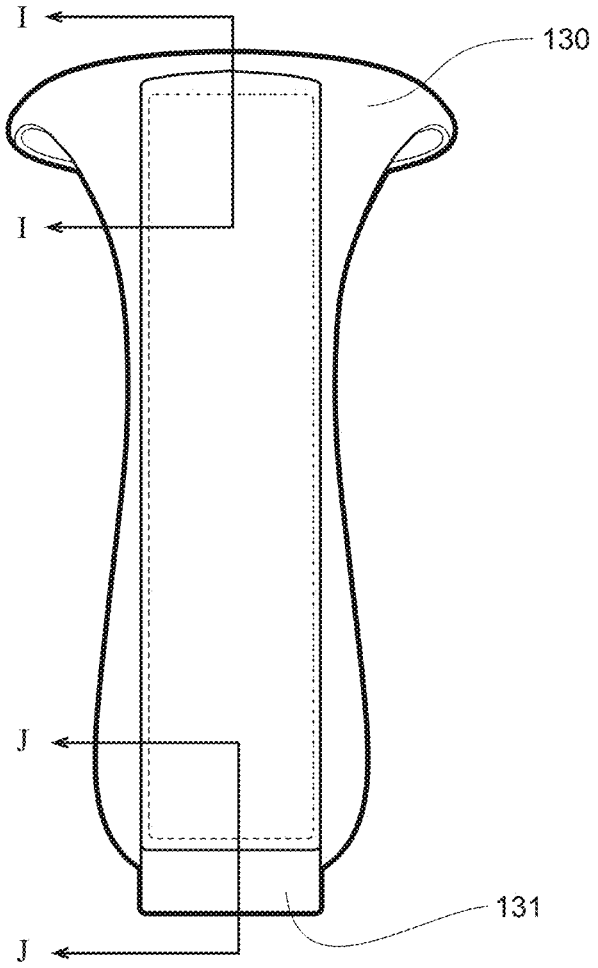
FIG. 25 is a rear view of an alternate preferred hand strap and bottle clip, shown removed from a preferred bottle.
Figure 26:
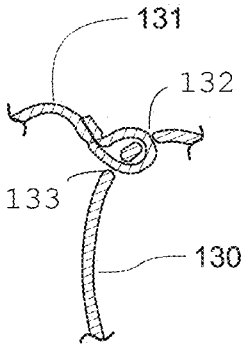
FIG. 26 is a section view through section I-I of FIG. 25.
Figure 27:
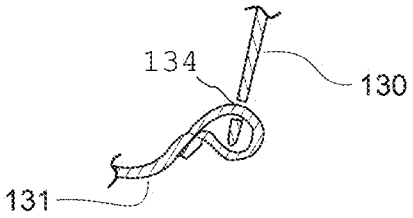
FIG. 27 is a section view through section J-J of FIG. 25.

FIG. 25 is a rear view of a clip 130 with strap 131 installed wherein clip 130 is shown removed from the preferable bottle. FIG. 26 is a section view through section I-I of FIG. 25. FIG. 27 is a section view through section J-J of FIG. 25. Strap 131 is threaded through upper slots 132, 133, then folded over on itself and stitched in place as shown in FIG. 26, and is threaded through lower slot 134 and then folded over on itself and stitched in place as shown in FIG. 27, wherein strap 131 is held retained in clip 130.

It should be noted that it may be desirable to use a small swatch of hook material (such as Velcro) to fasten strap 131 to itself either on the top strap connection and/or the bottom strap connection instead of sewing the strap 131 to itself. For example, the strap 131 would use velstretch material with a small section of hook Velcro attached by sewing, ultrasonic bonding or the like to the non-loop side and thus at the point of attachment as seen in FIG. 26 and FIG. 27 this attachment would be made by the mating the hook Velcro to the loop velstretch material and thus this attachment could be made less permanent and more easily removable/exchangeable.

The strap and clip attachment and adjustment embodiments shown in FIGS. 13 through 27 can be combined in various ways as desired. For example, clip and strap top attachment method shown in FIG. 17 could be combined with clip and strap bottom attachment method shown in FIG. 21; clip and strap top attachment method shown in FIG. 14 could be combined with clip and strap bottom attachment method shown in FIG. 18, etc.

Figure 28:
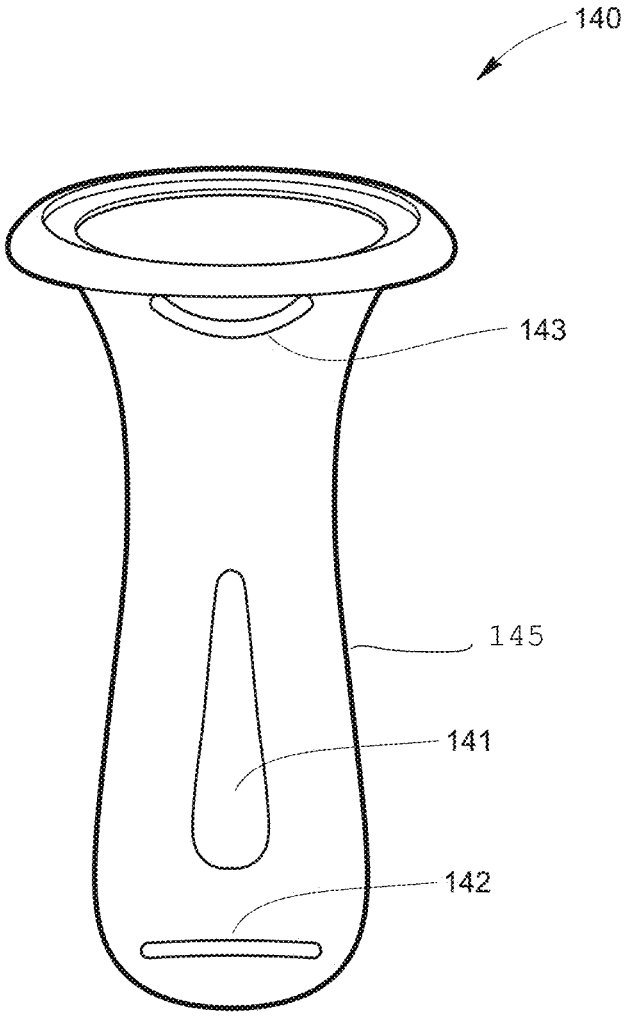
FIG. 28 is a front view of an alternate preferred bottle clip, shown without a hand strap and removed from a preferred bottle.
Figure 29:
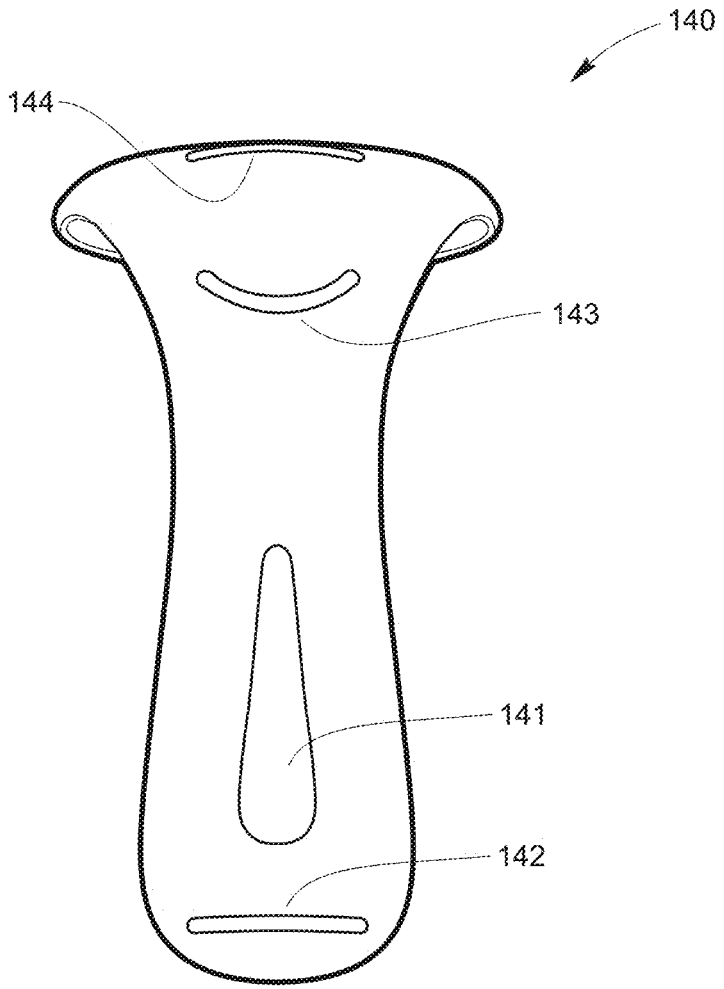
FIG. 29 is a rear view of the clip of FIG. 28.
Figure 30:
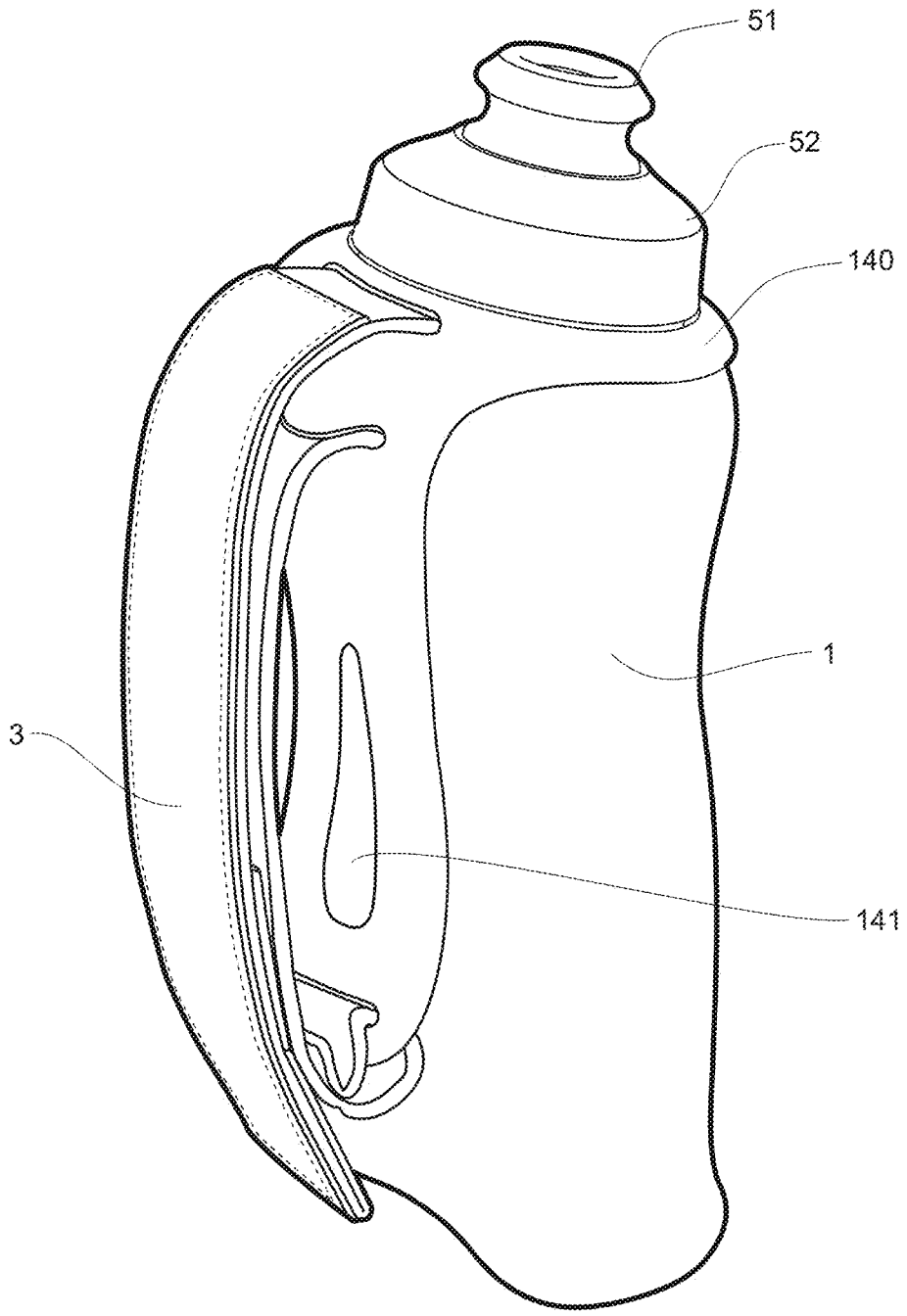
FIG. 30 is a rear three-quarter perspective view of the clip of FIG. 28, installed on a preferred bottle and including a hand strap.

FIG. 28 through FIG. 30 show a clip embodiment wherein clip 140 has a through-hole 141 positioned along an intermediate portion 145 of the clip, which may be desirable in some cases to reduce weight, for comfort reasons, aesthetics, etc. FIG. 28 is a front view of this alternate clip 140. Lower slot 142 and intermediate slot 143 are visible in this illustration. FIG. 29 is a rear view of clip 140, in which an upper slot 144 is also visible. FIG. 30 is a rear three-quarter perspective view of clip embodiment 140 installed with bottle 1, strap components and cap 52 with spout 51.

Figure 31:
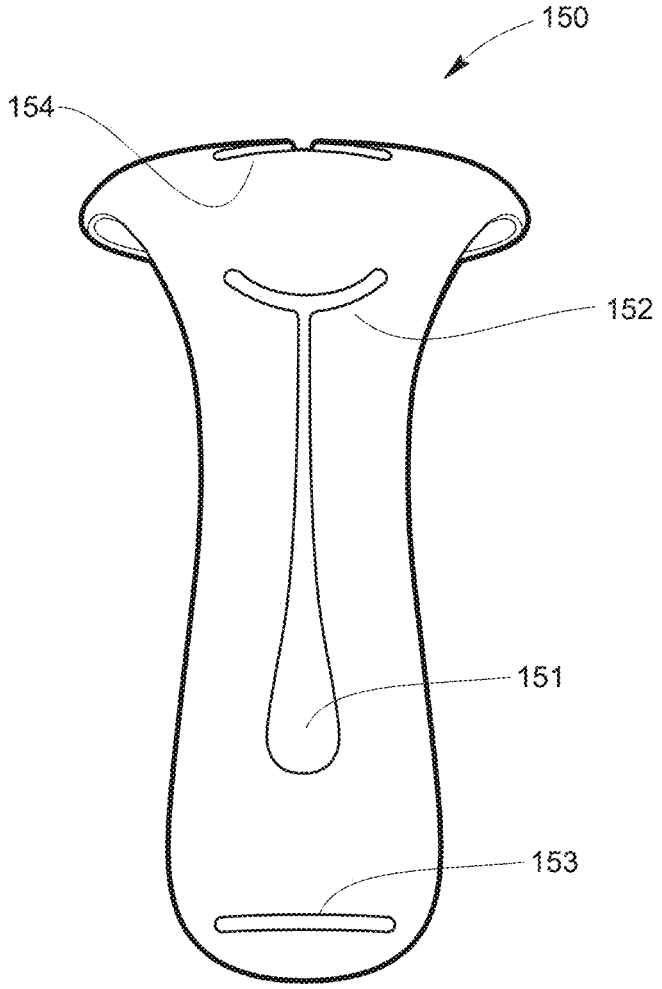
FIG. 31 is a front view of an alternate version of a preferred bottle clip, shown without a hand strap and removed from a preferred bottle.
Figure 32:
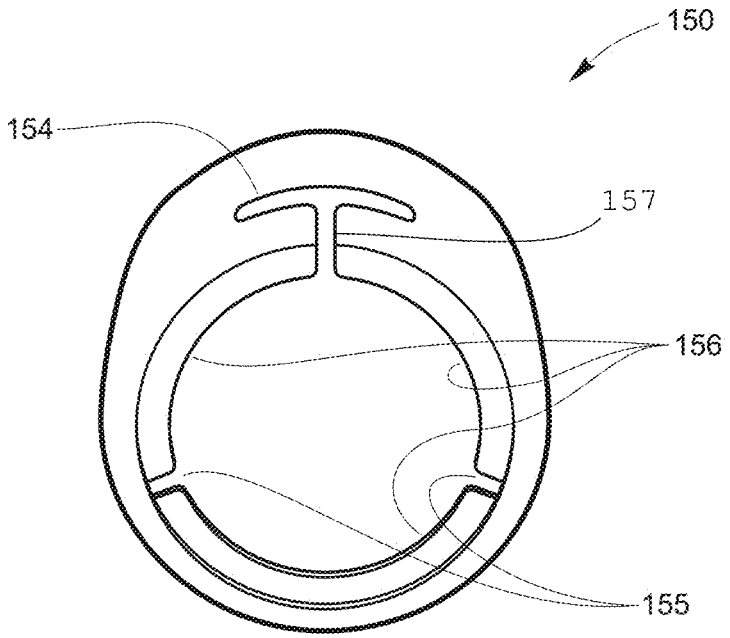
FIG. 32 is a top view of the clip of FIG. 31.

FIG. 31 is a front view of an alternate clip 150, while FIG. 32 is a top view. These views show another clip embodiment wherein clip 150 has through-hole 151 which extends up to and joins with intermediate slot 152. It may be desirable in some cases for through-hole 151 to extend downward to and join continuously with lower slot 153, either instead of or in addition to the joinder with the intermediate slot 152. In some cases creating a passageway into slots 152 and/or 153 may be desirable for ease of assembling the strap element. In the top view of FIG. 32, slot 154 also is shown with a passageway 157 into upper slot 154 which could facilitate attachment of the strap element. FIG. 32 also illustrates cuts 155 in thinned step area 156, which could facilitate assembly of clip 150 to bottle.

Figure 37:
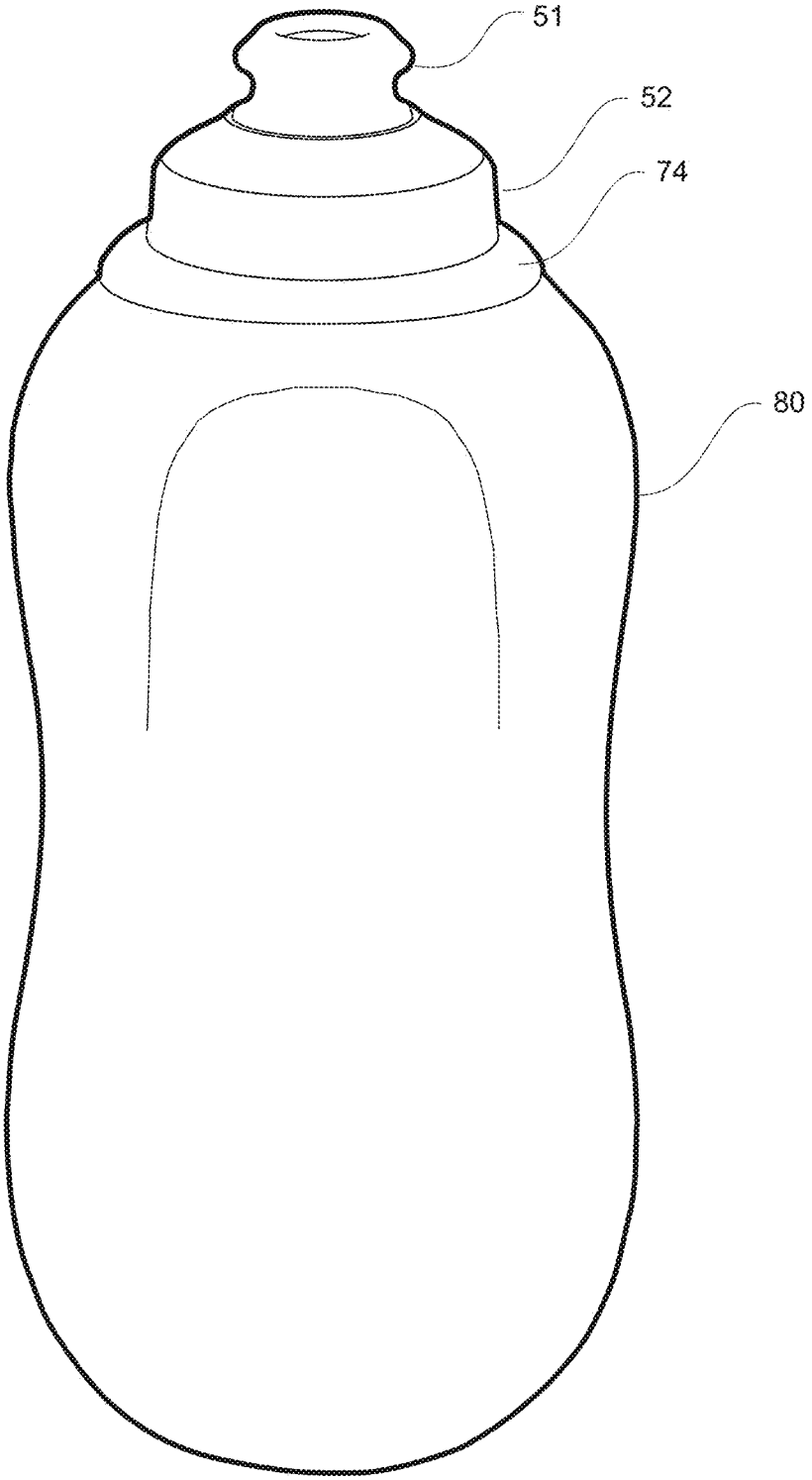
FIG. 37 is a front view of a preferred bottle.
Figure 38:
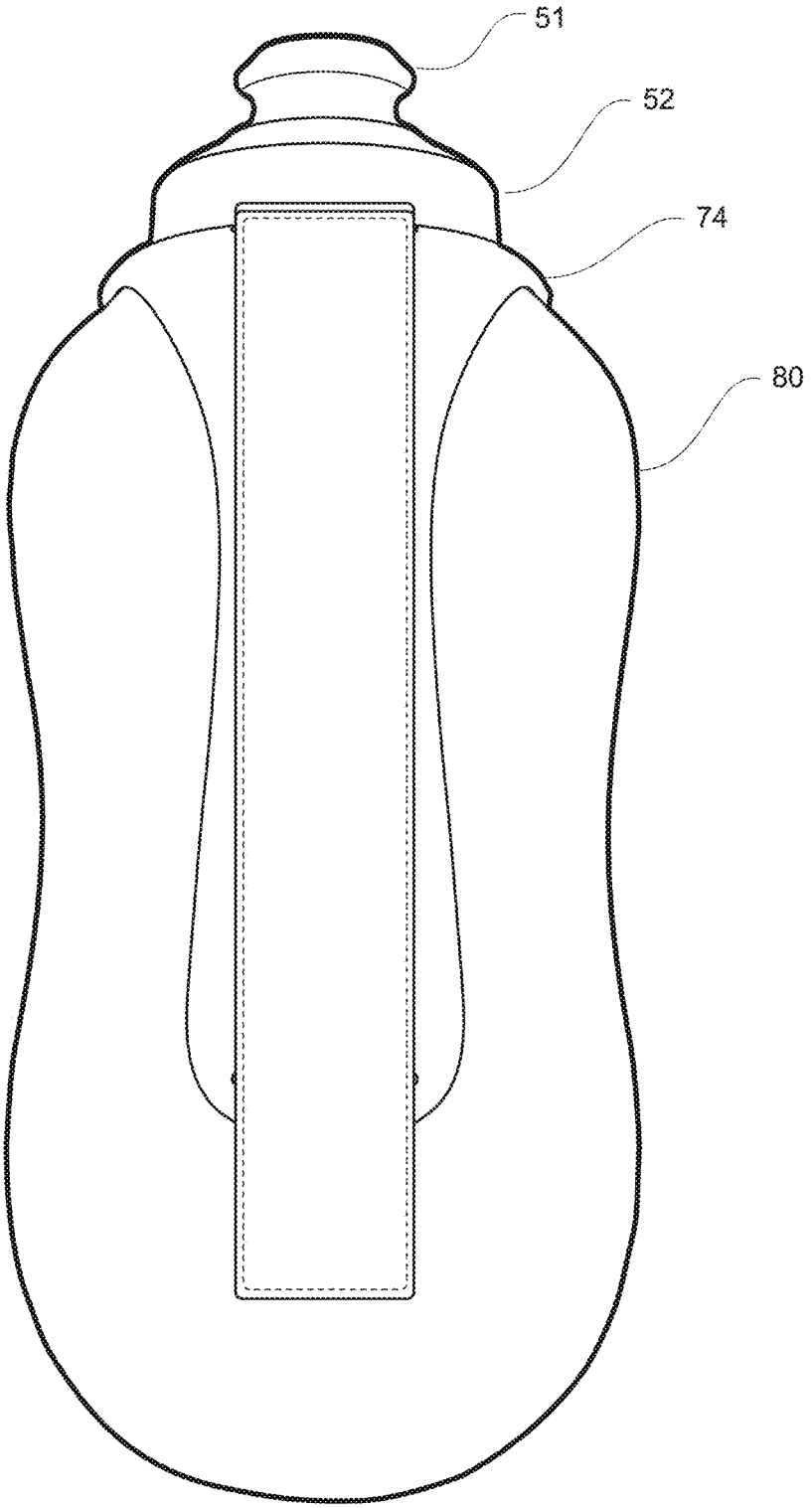
FIG. 38 is a rear view of the embodiment shown in FIG. 37.

FIG. 37 is a front view of another embodiment wherein the disclosed bottle 80 is shaped in a rounded way such that it is soft against the hand/body and more easily placed in a pocket when a user is in motion. As illustrated, the bottle includes a cap 52 with spout 51 retaining a clip 74. In use, the bottle may be held in a pocket and the clip could be outside the pocket such that a user easily places a hand in the loop 50 to remove and replace the bottle more easily into a pocket. FIG. 38 is a rear view of the embodiment shown in FIG. 37.

Figure 39:
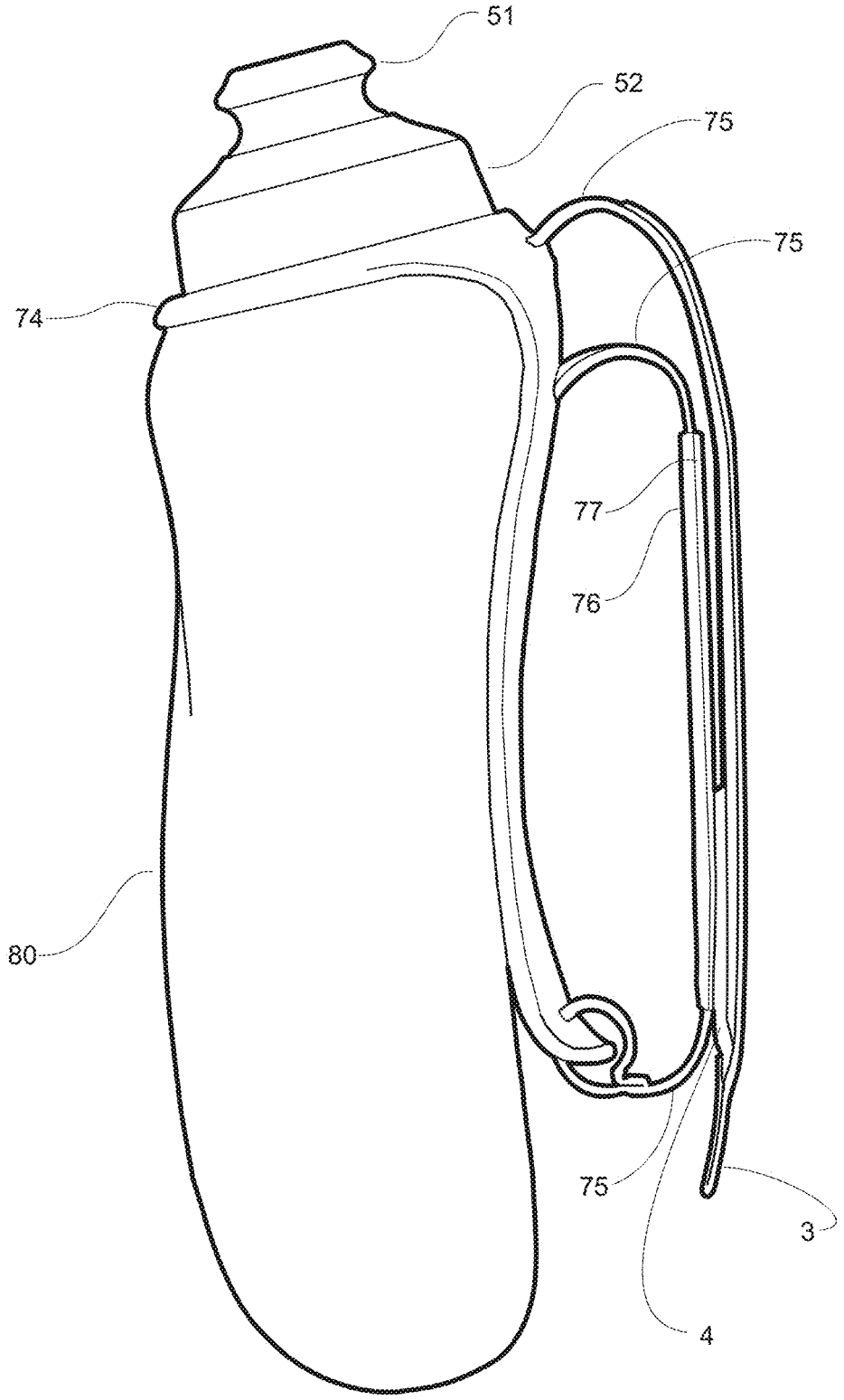
FIG. 39 is a right side of the embodiment shown in FIG. 37 the left side being a mirror image.

FIG. 39 is a right side of the embodiment shown in FIGS. 37 and 38; the left side view being a mirror image. A strap 75 formed from webbing of Nylon or other materials is shown, as well as logo/tag area 3, hook material 4, loop material 77, and hand anti-chafe cover 76. In some cases it is desirable for a nylon, polypropylene or other webbing to be used for the strap 75 to provide desired stability, and for hook material 4 and logo material 3 to be sewn or otherwise attached. Loop material 77 is also sewn or otherwise attached to webbing strap 75 preferably adjacent the other end of webbing 75 such that loop (e.g., Velcro) 77 resides on strap 75 preferably facing away from clip/bottle wherein anti-chafe cover 76 is preferably sewn or otherwise installed on webbing 75 facing toward the clip/bottle such that it provides a desired soft anti-chafing function. Anti-chafe cover 76 can be a swatch of soft moleskin, Coolmax, Veltex, felted, cushioned or other fabric that provides a desired soft somewhat cushioned feel. A portion of webbing 75 is preferably sandwiched between loop material 77 and anti-chafe cover 76 wherein the outer engagement surface of Velcro 77 is placed opposite the outer soft surface of anti-chafe cover 76. The outer engagement surface of loop material 77 facing away from clip/bottle such that it can engage with hook material (e.g., Velcro) 4 and the outer soft surface of anti-chafe cover 76 facing toward clip/bottle such that it provides a cushioned interface with a user's hand.

Figure 40:
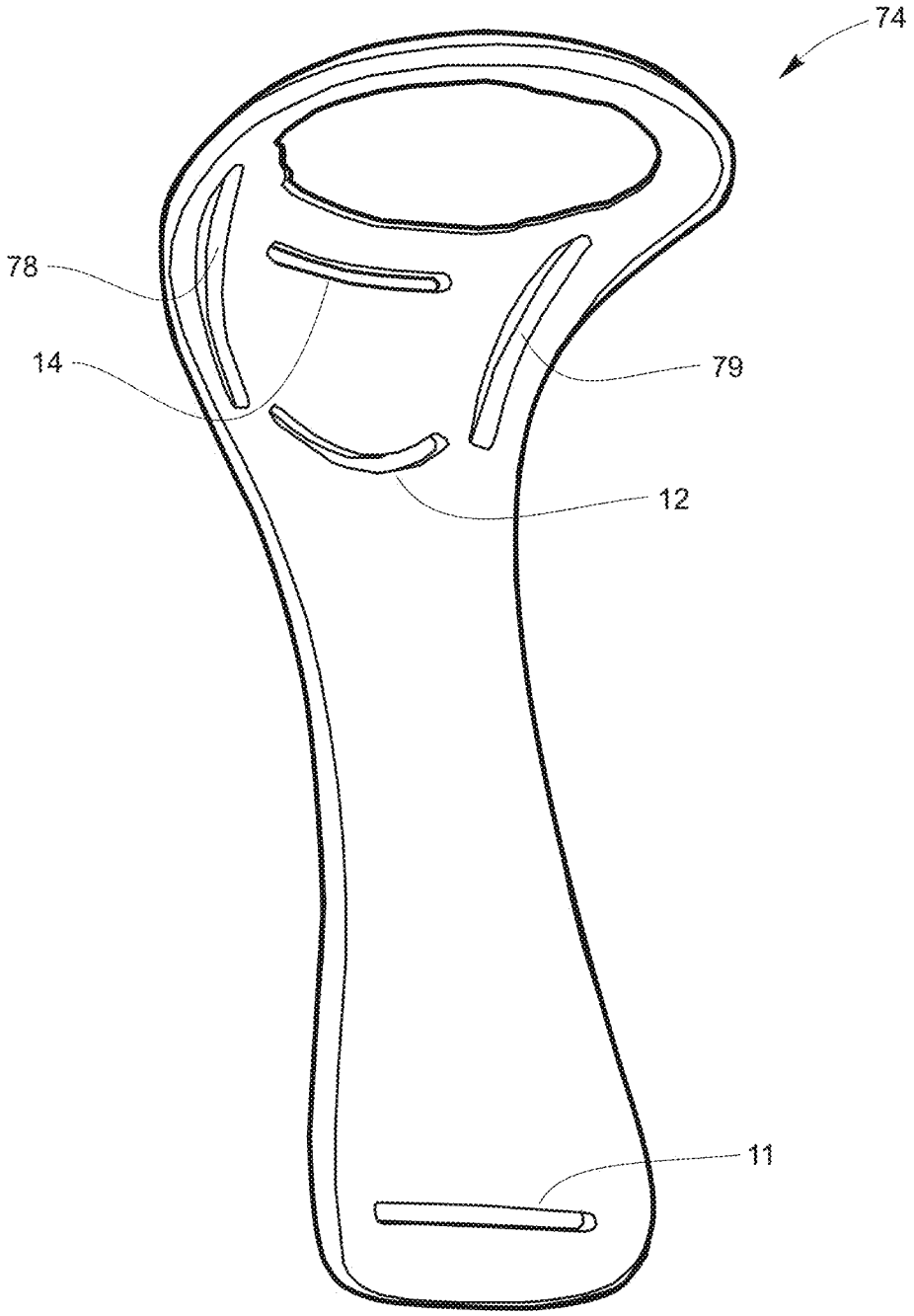
FIG. 40 is a perspective view of a preferred clip.
Figure 41:
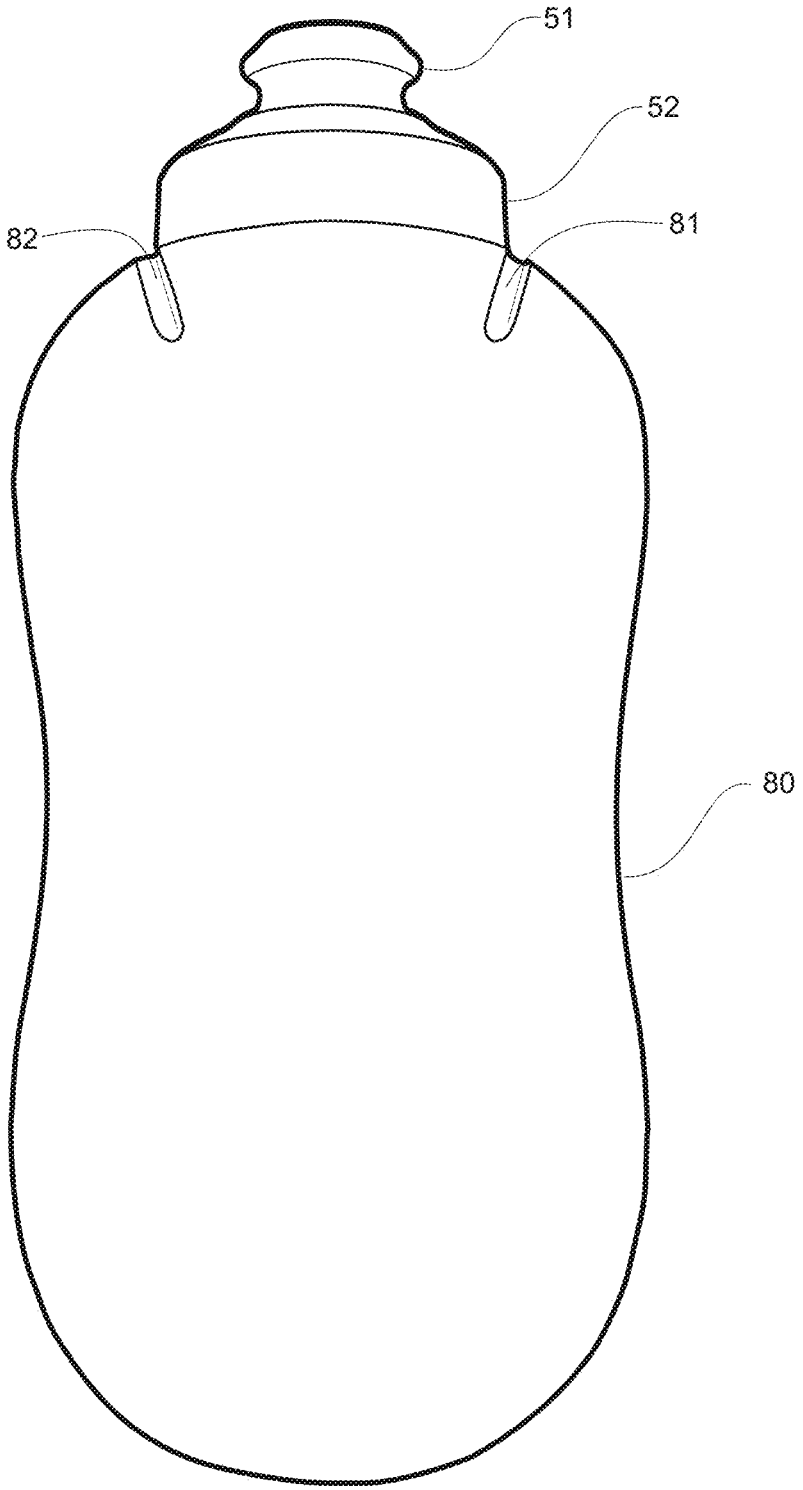
FIG. 41 is a rear view of a preferred bottle shown without a clip to indicate optional attachment features.

FIG. 40 is a perspective view of an embodiment of a clip 74 wherein ribs 78 and 79 are shown such that it can be understood that ribs 78 and 79 protrude from the inside surface of clip 74 providing strength to clip 74 but also serving to nest into recesses 81 and 82 formed in a bottle as illustrated in FIG. 41. In this version, rib 78 is held in place in recess 81 and rib 79 is held in recess 82, with the cap 52 holding the clip firmly in place and stopping it from twisting on bottle 80. FIG. 40 is an inside view wherein the inside of clip 74 would be in contact against bottle 80 and mating features 78 with 81 and 79 with 82 would be substantially hidden from view than clip 74 is installed on bottle 80. In FIG. 40 clip 74 is shown separated from bottle 80 and in FIG. 41 bottle 80 is shown separated from clip 74 such that that these mating features can be more easily seen and understood.

The spout 51 is preferably molded from TPU, silicone or the like and is fashioned to be a push-pull-style valve commonly used in the industry wherein when a user pulls up on spout 51 the spout opens a passageway so that liquid can flow. Spout 51 preferably incorporates a diaphragm-type valve fashioned with a slit or "x"-shaped cut that deforms to allow fluids to flow. Cap 52 is preferably manufactured from polypropylene or HDPE or other suitable materials.

The invention can be constructed by integrally forming and/or otherwise fastening parts together that have been manufactured from a variety of processes and techniques such as described above, but may be constructed differently. For example various parts of the invention could be combined, molded as one, woven, heat sealed together, ultrasonically bonded together or formed in other ways.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

We claim:

1. A hand strap bottle clip for use with a bottle, the bottle having a lower end and an opposite upper end with a neck and a bottle cap, the hand strap bottle clip comprising:

a clip having an upper end and a lower end, the upper end of the clip being attachable to the upper end of the bottle wherein the lower end of the clip extends downwardly toward the lower end of the bottle when the clip is attached to the bottle, the clip further being configured to support the bottle by attachment of the clip to a belt;

the clip further having an upper slot at the upper end of the clip and a lower slot at the lower end of the clip; and a strap attached to the clip at the upper slot and at the lower slot, whereby the strap and the clip combine to form a hand loop sized to accommodate a hand of a user.

2. The hand strap bottle clip of claim 1, wherein:

the clip further having an intermediate slot between the upper slot and the lower slot, and wherein the strap extends through the upper slot, the intermediate slot, and the lower slot.

3. The hand strap bottle clip of claim 2, wherein the strap includes a first end attached to the lower slot, an intermediate portion extending through the intermediate slot and through the upper slot to form a hand loop portion between the lower slot and the intermediate slot, the strap further having a second end extending beyond the upper slot, the second end being removably attached to the hand loop portion.

4. The hand strap bottle clip of claim 3, wherein the intermediate slot is curved upwardly.

5. The hand strap bottle clip of claim 3, wherein the strap further comprises a swatch of hook material, wherein the second end of the strap is removably attached to the hand loop portion by removable attachment of the swatch of hook material.

6. The hand strap bottle clip of claim 5, wherein the swatch of hook material is attached to the second end of the strap.

7. The hand strap bottle clip of claim 1, wherein the strap is formed from an elastomeric material.

8. The hand strap bottle clip of claim 1, wherein the upper end of the clip comprises an opening for receiving the neck of a bottle, the upper end of the clip defining a plane, and further wherein the lower end of the clip extends away from the plane in a direction defining a first acute angle in the relaxed state and defining a second acute angle in the tension state, the first acute angle being smaller than the second acute angle.

9. The hand strap bottle clip of claim 8 further comprising one or more projections extending radially inward from the opening.

10. The hand strap bottle clip of claim 8, wherein the bottle comprises one or more steps sized and positioned to receive the one or more projections, whereby the one or more projections and the one or more steps cooperate to prevent rotation of the clip with respect to a central axis extending through the neck of the bottle.

11. The hand strap bottle clip of claim 2, wherein:

the strap includes a first end attached to the lower slot, an intermediate portion extending through the intermediate slot and through the upper slot to form a hand loop portion between the lower slot and the intermediate slot, the strap further having a second end extending beyond the upper slot, the second end being removably attached to the hand loop portion;

further wherein the strap is formed from an elastomeric material; and an outer layer is attached to the second end of the strap, the outer layer being formed from a non-elastomeric material.

12. The hand strap bottle clip of claim 11, wherein the upper slot is separated from the intermediate slot to define an expansion area between the hand loop portion and the second end of the strap, whereby the hand loop area is resiliently expandable into the expansion area.

13. A hand strap bottle clip for use with a bottle, the bottle having a lower end extending upwardly to an upper end with a neck and a bottle cap, the hand strap bottle clip comprising:

a clip having an upper end with an opening configured to receive the neck of the bottle within the clip and to retain the clip to the bottle when the cap is attached to the neck;

the clip having a lower end extending downwardly toward the lower end of the bottle when the clip is attached to the bottle;

the clip further having an upper attachment location at the upper end of the clip and a lower attachment location at the lower end of the clip; and a strap attached to the clip at the upper attachment location and at the lower attachment location, whereby the strap and the clip combine to form a hand loop sized to accommodate a hand of a user.

14. The hand strap bottle clip of claim 13, wherein:

the upper attachment location comprises an upper slot and the lower attachment location comprises a lower slot;

the clip further having an intermediate slot between the upper slot and the lower slot, and wherein the strap extends through the upper slot, the intermediate slot, and the lower slot.

15. The hand strap bottle clip of claim 14, wherein the strap includes a first end attached to the lower slot, an intermediate portion extending through the intermediate slot and through the upper slot to form a hand loop portion between the lower slot and the intermediate slot, the strap further having a second end extending beyond the upper slot, the second end being removably attached to the hand loop portion.

16. The hand strap bottle clip of claim 15, wherein the strap is formed from an elastomeric material, and an outer layer is attached to the second end of the strap, the outer layer being formed from a non-elastomeric material.

17. The hand strap bottle clip of claim 16 wherein the upper slot is separated from the intermediate slot to define an expansion area between the hand loop portion and the second end of the strap, whereby the hand loop portion is resiliently expandable into the expansion area.

18. The hand strap bottle clip of claim 13, wherein the clip is in a relaxed state when removed from the bottle and in a tension state when attached to the bottle, wherein in the tension state the lower end of the clip is in contact with and urged against a sidewall of the bottle.

19. The hand strap bottle clip of claim 14, wherein the clip further comprises an elongated through-hole extending between the intermediate slot and the lower slot.

* * * * *